US011025004B2

(12) United States Patent
Consoli et al.

(10) Patent No.: US 11,025,004 B2
(45) **Date of Patent: *Jun. 1, 2021**

(54) CIRCUIT CARD ASSEMBLIES FOR A COMMUNICATION SYSTEM

(71) Applicant: TE Connectivity Services GmbH, Schaffhausen (CH)

(72) Inventors: John Joseph Consoli, Harrisburg, PA (US); Howard Wallace Andrews, Jr., Hummelstown, PA (US)

(73) Assignee: TE CONNECTIVITY SERVICES GmbH, Schaffhausen (CH)

( * ) Notice: Subject to any disclaimer, the term of this patent is extended or adjusted under 35 U.S.C. 154(b) by 0 days.

This patent is subject to a terminal disclaimer.

(21) Appl. No.: 15/945,821

(22) Filed: Apr. 5, 2018

(65) Prior Publication Data

US 2019/0052014 A1 Feb. 14, 2019

Related U.S. Application Data

(60) Provisional application No. 62/543,072, filed on Aug. 9, 2017.

(51) Int. Cl.
*H01R 13/629* (2006.01)
*H01R 13/24* (2006.01)
(Continued)

(52) U.S. Cl.
CPC ... *H01R 13/62922* (2013.01); *H01R 12/7011* (2013.01); *H01R 12/721* (2013.01);
(Continued)

(58) Field of Classification Search
CPC .. H01R 12/83; H01R 12/721; H01R 12/7011; H01R 13/62922; H01R 13/62938;
(Continued)

(56) References Cited

U.S. PATENT DOCUMENTS 3,587,029 A 6/1971 Knowles
4,560,221 A 12/1985 Olsson
(Continued)

FOREIGN PATENT DOCUMENTS

EP 2346117 A2 7/2011
EP 2451262 A2 5/2012
(Continued)

OTHER PUBLICATIONS

Kerridge et al., 'Fast Backplane Connectors Disguise Digital Transmission Lines,' (Texas Instrument), Reed Business Information, Highlands Ranch, CO, US, vol. 42, No. Europe, May 8, 1997, XP000724062.

(Continued)

*Primary Examiner* — Travis S Chambers

(57) ABSTRACT

A communication system includes a first circuit card assembly having a first PCB and a first electrical connector having a receptacle housing and a mating housing received in the receptacle housing and being movable in the receptacle housing in a connector mating direction along a connector mating axis. The second circuit card assembly includes a second PCB and a second electrical connector having a header housing holding second contacts. The first PCB and/or the second PCB includes a slot receiving the other PCB in a board loading direction. The receptacle housing is coupled to the header housing in the board loading direction and the mating housing is movable within the receptacle housing toward the header housing in a connector mating direction generally perpendicular to the board loading direction.

20 Claims, 11 Drawing Sheets

(51) Int. Cl.

| | |
|---|---|
| ***H01R 12/72*** | (2011.01) |
| ***H01R 13/502*** | (2006.01) |
| ***H01R 12/73*** | (2011.01) |
| ***H01R 12/87*** | (2011.01) |
| ***H01R 12/70*** | (2011.01) |
| ***H01R 12/83*** | (2011.01) |

(52) U.S. Cl.
CPC ..... *H01R 12/727* (2013.01); *H01R 12/737* (2013.01); *H01R 12/83* (2013.01); *H01R 12/87* (2013.01); *H01R 13/2428* (2013.01); *H01R 13/502* (2013.01); *H01R 13/62938* (2013.01)

(58) Field of Classification Search
CPC .... H01R 12/727; H01R 12/737; H01R 12/87; H01R 13/2428; H01R 13/502
USPC ..... 439/65, 157
See application file for complete search history.

(56) References Cited

U.S. PATENT DOCUMENTS

| | | | | |
|---|---|---|---|---|
| 5,114,353 | A * | 5/1992 | Sample | H01R 23/68 361/791 |
| 5,676,559 | A | 10/1997 | Laub et al. | |
| 6,267,604 | B1 | 7/2001 | Mickievicz et al. | |
| 6,796,822 | B2 | 9/2004 | Sato et al. | |
| 6,918,775 | B2 | 7/2005 | Korsunsky et al. | |
| 7,086,866 | B1 | 8/2006 | Folan et al. | |
| 7,322,834 | B2 | 1/2008 | Hu et al. | |
| 7,326,092 | B2 | 2/2008 | Fedder et al. | |
| 7,435,095 | B1 | 10/2008 | Yi | |
| 7,540,744 | B1 | 6/2009 | Minich | |
| 7,708,578 | B1 | 5/2010 | Lenox | |
| 7,771,207 | B2 | 8/2010 | Hamner et al. | |
| 7,789,668 | B1 | 9/2010 | Hamner et al. | |
| 7,824,187 | B1 | 11/2010 | Yi | |
| 7,918,683 | B1 | 4/2011 | Hamner et al. | |
| 7,988,457 | B1 | 8/2011 | Morgan | |
| 8,113,851 | B2 | 2/2012 | Hamner et al. | |
| 8,199,511 | B2 | 6/2012 | Kim et al. | |
| 8,376,766 | B1 | 2/2013 | Huettner et al. | |
| 8,512,081 | B2 | 8/2013 | Stokoe | |
| 8,684,610 | B2 | 4/2014 | Nichols et al. | |
| 9,551,625 | B2 | 1/2017 | Brugger | |
| 9,608,371 | B2 | 3/2017 | Bonzom et al. | |
| 9,608,382 | B2 | 3/2017 | McClellan et al. | |
| 9,917,406 | B1 | 3/2018 | Iwasaki et al. | |
| 10,355,383 | B2 * | 7/2019 | Consoli | H01R 12/737 |
| 10,381,762 | B2 * | 8/2019 | Consoli | H01R 12/737 |
| 10,411,378 | B2 * | 9/2019 | Consoli | H01R 13/62905 |
| 10,461,470 | B2 * | 10/2019 | Consoli | H01R 13/62938 |
| 2002/0071259 | A1 | 6/2002 | Roos | |
| 2005/0064733 | A1 | 3/2005 | Korsunsky et al. | |
| 2005/0070136 | A1 | 3/2005 | Korsunsky et al. | |
| 2005/0181637 | A1 | 8/2005 | Williams et al. | |
| 2007/0184676 | A1 | 8/2007 | Minich | |
| 2008/0045087 | A1 * | 2/2008 | Yi | H05K 7/1445 439/637 |
| 2008/0166901 | A1 | 7/2008 | Weber | |
| 2014/0065849 | A1 * | 3/2014 | Kida | H01R 12/7023 439/65 |
| 2016/0006150 | A1 * | 1/2016 | Bachmutsky | H01R 12/722 439/65 |
| 2018/0040989 | A1 | 2/2018 | Chen | |
| 2018/0261941 | A1 * | 9/2018 | Consoli | H01R 12/737 |
| 2019/0052001 | A1 * | 2/2019 | Consoli | H01R 12/87 |
| 2019/0103691 | A1 * | 4/2019 | Sypolt | H05K 7/1417 |
| 2019/0319384 | A1 * | 10/2019 | Consoli | H01R 12/712 |

FOREIGN PATENT DOCUMENTS

| | | | |
|---|---|---|---|
| JP | 2003044794 | A | 2/2003 |
| TW | M537321 | U | 2/2017 |
| WO | 2007092113 | A2 | 8/2007 |

OTHER PUBLICATIONS

ISR and Written Opinion issued for PCT/IB2018/055476 dated Oct. 19, 2018.
Co-pending U.S. Appl. No. 15/945,802, filed Apr. 5, 2018.
Co-pending U.S. Appl. No. 15/945,787, filed Apr. 5, 2018.
Co-pending U.S. Appl. No. 15/945,767, filed Apr. 5, 2018.
Co-pending U.S. Appl. No. 15/945,775, filed Apr. 5, 2018.
Co-pending U.S. Appl. No. 15/945,812, filed Apr. 5, 2018.

* cited by examiner

CIRCUIT CARD ASSEMBLIES FOR A COMMUNICATION SYSTEM

CROSS REFERENCE TO RELATED APPLICATIONS

This application claims benefit to U.S. Provisional Application No. 62/543,072, filed Aug. 9, 2017, titled "CIRCUIT CARD ASSEMBLIES FOR A COMMUNICATION SYSTEM", the subject matter of which is herein incorporated by reference in its entirety.

BACKGROUND OF THE INVENTION

The subject matter herein relates generally to circuit card assemblies for communication systems.

Communication systems are in use in various applications, such as network switches. The communication systems include various circuit cards, such as backplanes and/or daughtercards, which are coupled together to electrically connect various circuits. For example, the circuit cards include electrical connectors that are mated to electrical connectors of one or more other circuit cards. Some communication systems use a backplane or midplane that is perpendicular to the mating direction of the daughtercards. However, such backplanes or midplanes block airflow through the communication system leading to overheating of components or limiting operating speeds to avoid overheating.

Other communication systems arrange both circuit cards parallel to the mating direction to allow airflow through the system. The circuit cards are typically oriented perpendicular to each other (for example, horizontally and vertically). The electrical connectors are provided at edges of both circuit cards and direct mate to each other. Conventional communication systems utilize right angle electrical connectors on both cards that direct mate with each other in an orthogonal orientation. The mating interfaces of the electrical connectors are parallel to the mating edges of the circuit cards such that the electrical connectors are mated in a direction parallel to the mating direction of the circuit cards. However, such right angle electrical connectors are expensive to manufacture and occupy a large amount of space in the system, thus blocking airflow through the system.

A need remains for a cost effective and reliable communication system allowing airflow through the communication system for cooling the electrical components.

BRIEF DESCRIPTION OF THE INVENTION

In one embodiment, a communication system is provided including a first circuit card assembly and a second circuit card assembly. The first circuit card assembly includes a first printed circuit board (PCB) and a first electrical connector mounted to the first PCB, the first electrical connector having a first mating end and first contacts at the first mating end, each of the first contacts having a first mating interface, the first electrical connector having a receptacle housing and a mating housing received in the receptacle housing and being movable in the receptacle housing in a connector mating direction along a connector mating axis. The second circuit card assembly includes a second PCB and a second electrical connector mounted to the second PCB, the second electrical connector having a second mating end and second contacts at the second mating end, each of the second contacts having a second mating interface, the second electrical connector having a header housing holding the second contacts. At least one of the first PCB and the second PCB includes a slot receiving the other of the first PCB and the second PCB in a board loading direction along a board loading axis. The receptacle housing is coupled to the header housing in the board loading direction as the first PCB and the second PCB are mated, and wherein the mating housing is movable within the receptacle housing toward the header housing in the connector mating direction generally perpendicular to the board loading direction.

In another embodiment, a circuit card assembly for a communication system is provided including a printed circuit board (PCB) having a first surface and a second surface and a mating edge between the first and second surfaces. The PCB having a slot extending inward from the mating edge configured to receive a second PCB of a second circuit card assembly in a board loading direction perpendicular to the mating edge. The PCB has a mounting area on the first surface adjacent the slot. The circuit card assembly includes an electrical connector mounted to the first surface at the mounting area configured for mating with a second electrical connector of the second circuit card assembly. The electrical connector includes a receptacle housing mounted to the PCB and a mating housing received in the receptacle housing and being movable relative to the receptacle housing. The electrical connector extends between a front and a rear with the front being provided proximate to the mating edge. The electrical connector includes a mounting end extending between the front and the rear being mounted to the mounting area. The electrical connector includes a mating end extending between the front and the rear. The mating housing is provided at the mating end being configured to be mated to the second electrical connector. The electrical connector has contacts held by the mating housing and being movable relative to the receptacle housing with the mating housing. The receptacle housing is configured to be coupled to the second electrical connector as the second PCB is loaded in the board loading direction. The mating housing is movable within the receptacle housing toward the second electrical connector in a connector mating direction generally perpendicular to the board loading direction.

DETAILED DESCRIPTION OF THE INVENTION

Figure 1:
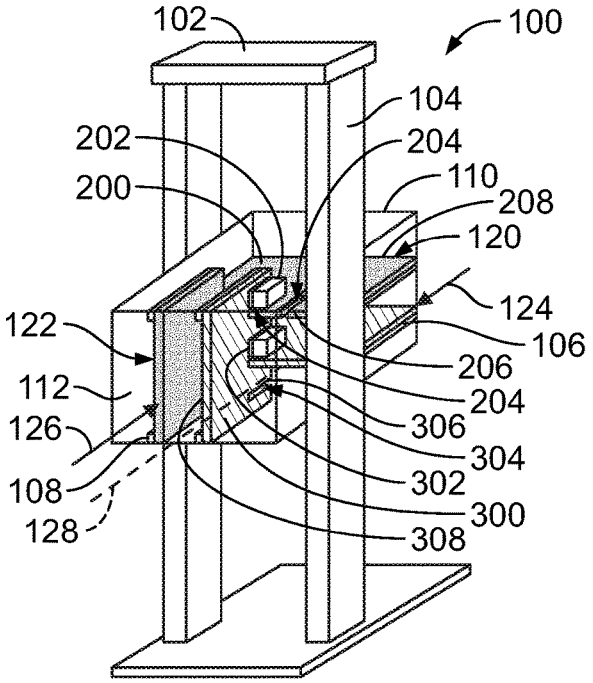
FIG. 1 illustrates a communication system formed in accordance with an exemplary embodiment.

FIG. 1 illustrates a communication system 100 formed in accordance with an exemplary embodiment. The communication system 100 includes a chassis 102 having a frame 104 configured to hold communication components, such as network components, such as circuit card assemblies. Optionally, the chassis 102 may include a cabinet (not shown) surrounding components of the communication system 100. In an exemplary embodiment, the frame 104 includes a plurality of racks 106, 108 for holding circuit card assemblies. For example, the communication system 100 may form part of a data center switch having one or more backplanes and/or daughter cards, such as line cards, switch cards or other types of circuit cards that may be electrically connected together.

In an exemplary embodiment, the communication system 100 includes a front end 110 and a rear end 112. The racks 106 are provided at the front end 110 and the racks 108 are provided at the rear end 112. One or more circuit card assemblies 120 may be received in the racks 106 at the front end 110 and one or more circuit card assemblies 122 may be received in the racks 108 at the rear end 112. The circuit card assemblies 120 may be referred to hereinafter as first circuit card assemblies 120 or front circuit card assemblies to differentiate from the circuit card assemblies 122, which may be referred to hereinafter as second circuit card assemblies 122 and/or rear circuit card assemblies 122. In an exemplary embodiment, the circuit card assemblies 120, 122 are orthogonal to each other. For example, in the illustrated embodiment, the front circuit card assemblies 120 are oriented horizontally while the rear circuit card assemblies 122 are oriented vertically; however, other orientations are possible in alternative embodiments.

The front circuit card assemblies 120 are electrically connected to one or more of the rear circuit card assemblies 122. Optionally, the front circuit card assemblies 120 and/or the rear circuit card assemblies 122 may be removable from the corresponding racks 106, 108. The racks 106, 108 guide and position the circuit card assemblies 120, 122, respectively. For example, the racks 106 position the front circuit card assemblies 120 for mating with multiple rear circuit card assemblies 122 and the racks 108 position the rear circuit card assemblies 122 for mating with multiple front circuit card assemblies 120. The front circuit card assemblies 120 may be loaded into the frame 104 through the front end 110 while the rear circuit card assemblies 122 may be loaded into the frame 104 through the rear end 112. For example, the front circuit card assemblies 120 are configured to be loaded into corresponding racks 106 in a loading direction 124 and the rear circuit card assemblies 122 are configured to be loaded into corresponding racks 108 in a loading direction 126. The loading directions 124, 126 may be parallel to a loading axis 128.

The first circuit card assembly 120 includes a first printed circuit board (PCB) 200 and a first electrical connector 202 mounted to the first PCB 200. The first PCB 200 may include any number of the electrical connectors 202, such as one electrical connector 202 for electrically connecting to each corresponding second circuit card assembly 122. Optionally, the first PCB 200 may include one or more first slots 204 for receiving PCBs of corresponding second circuit card assemblies 122 when mated thereto.

Figure 2:
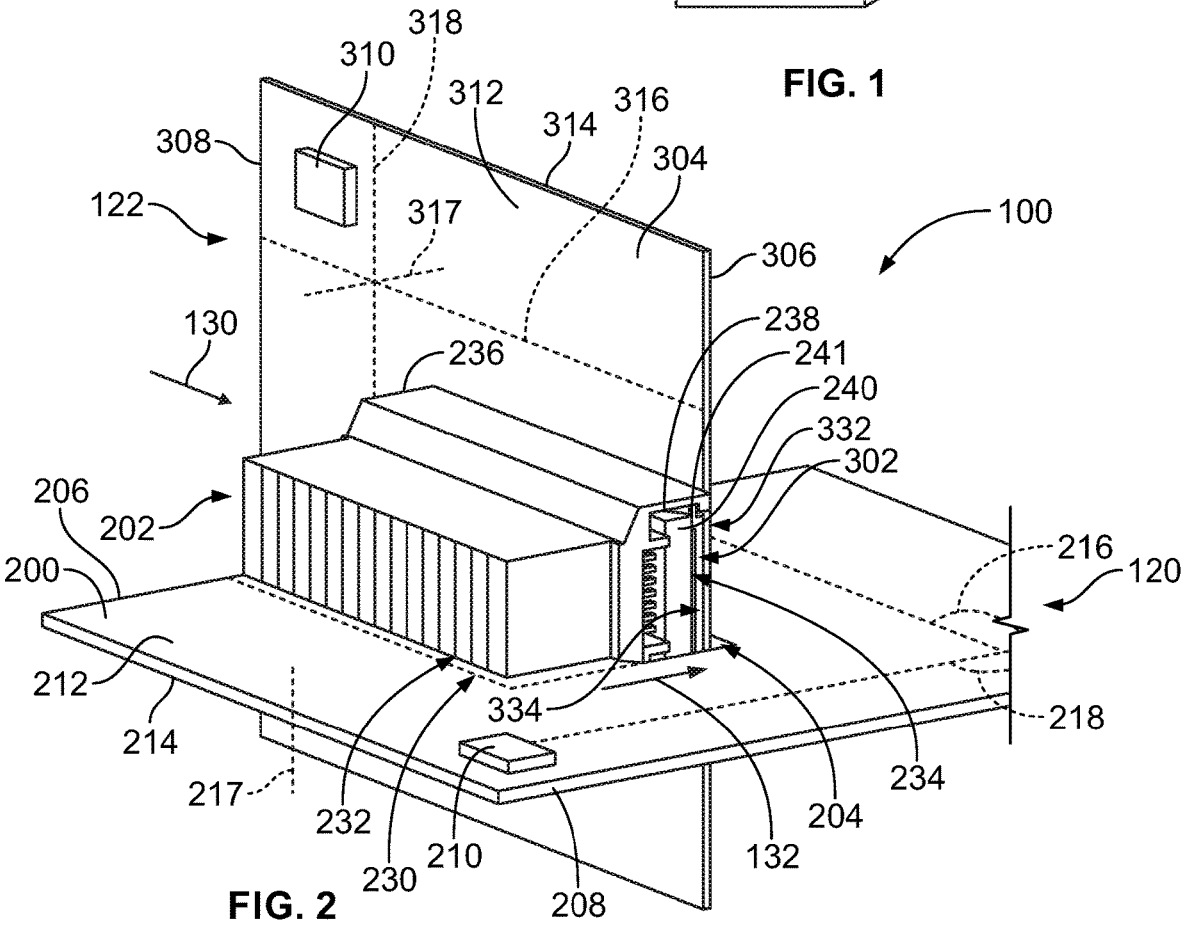
FIG. 2 is a perspective view of a portion of the communication system showing a first circuit card assembly coupled to a second circuit card assembly.

The first PCB 200 extends between a first mating edge 206 at a front of the PCB 200 and a rear edge 208 opposite the mating edge 206. Optionally, the rear edge 208 may include a handle or other feature for insertion and removal of the first circuit card assembly 120. The first PCB 200 may include one or more electrical components 210 (such as shown in FIG. 2) thereon. For example, the electrical components 210 may be processors, memory modules, batteries, fans, signal processing devices, and the like.

The second circuit card assembly 122 includes a second PCB 300 and a second electrical connector 302 mounted to the second PCB 300. The second PCB 300 may include any number of the electrical connectors 302, such as one electrical connector 302 for electrically connecting to each corresponding first circuit card assembly 120. The second PCB 300 extends between a second mating edge 306 at a front of the PCB 300 and a rear edge 308 opposite the mating edge 306. The first and second mating edges 206, 306 of the first and second PCBs 200, 300 interface with each other when the first and second circuit card assemblies 120, 122 are mated. For example, the fronts of the PCBs 200, 300 face each other and the rear edges 208, 308 face away from each other. Optionally, the rear edge 308 may include a handle or other feature for insertion and removal of the second circuit card assembly 122. The second PCB 300 may include one or more electrical components 310 (such as shown in FIG. 2) thereon. For example, the electrical components 310 may be processors, memory modules, batteries, fans, signal processing devices, and the like.

Optionally, the second PCB 300 may include one or more second slots 304 for receiving first PCBs 200 of corresponding first circuit card assemblies 120 when mated thereto. In various embodiments, both PCBs 200, 300 include the first and second slots 204, 304. In other various embodiments, only the first PCB 200 includes the first slots 204, whereas in other various embodiments, only the second PCB 300 includes the second slots 304.

The first slots 204 and/or the second slots 304 allow the first and second PCBs 200, 300 to be internested and overlapping such that the first and second electrical connectors 202, 302 are aligned for mating. For example, the first slots 204 and/or the second slots 304 allow the first and second PCBs 200, 300 to overlap to align mating ends of the first and second electrical connectors 202, 302 for mating. The arrangement allows the first and second electrical connectors 202, 302 to be mated in a mating direction perpendicular to the loading directions 124, 126. During mating, the first and second PCBs 200, 300 and the first and second electrical connectors 202, 302 may be loaded or mated together in a board loading direction 130 (FIG. 2) and at the end of the mating process the first and second electrical connectors 202, 302 may be mated in a connector mating direction 132 (FIG. 2) perpendicular to the board loading direction 130.

Having the first and second circuit card assemblies 122 internested and overlapped using the slot(s) 204, 304 allows the first and second electrical connectors 202, 302 to be elongated along the PCBs 200, 300 reducing one or more other dimensions of the electrical connectors 202, 302 (for example, a height and/or a width) allowing a greater amount of airflow through the communication system 100 (for example, from the front end 110 to the rear end 112 and/or from the rear end 112 to the front end 110. The arrangement may allow the PCBs 200, 300 to overlap to reduce one or more dimensions of the communication system 100, such as a front to rear length of the communication system 100.

Figure 4:
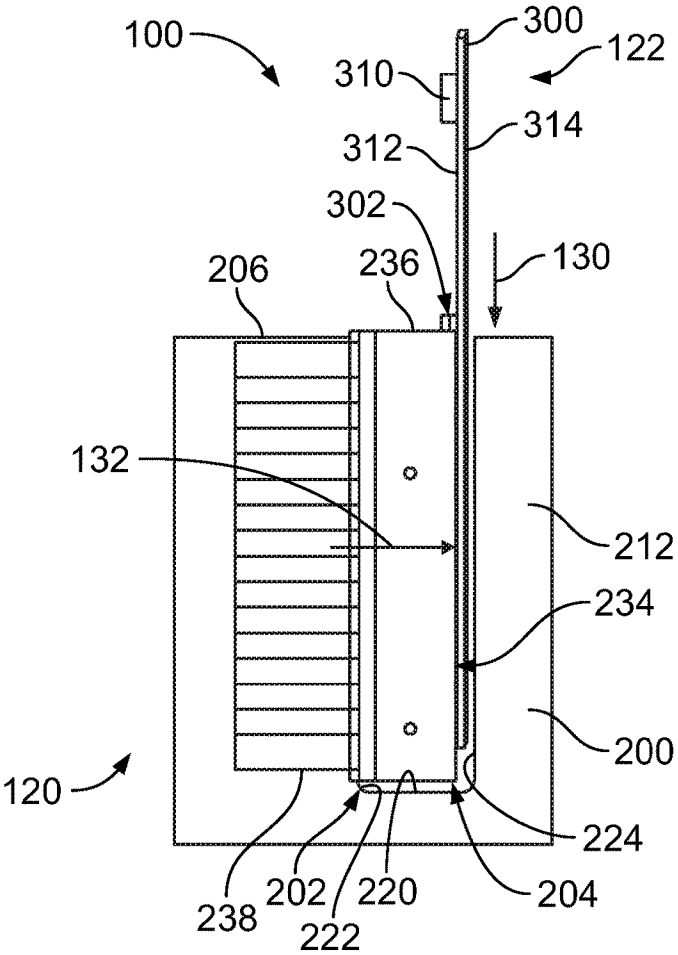
FIG. 4 is a top view of a portion of the communication system showing the first circuit card assembly mated to the second circuit card assembly.
Figure 3:
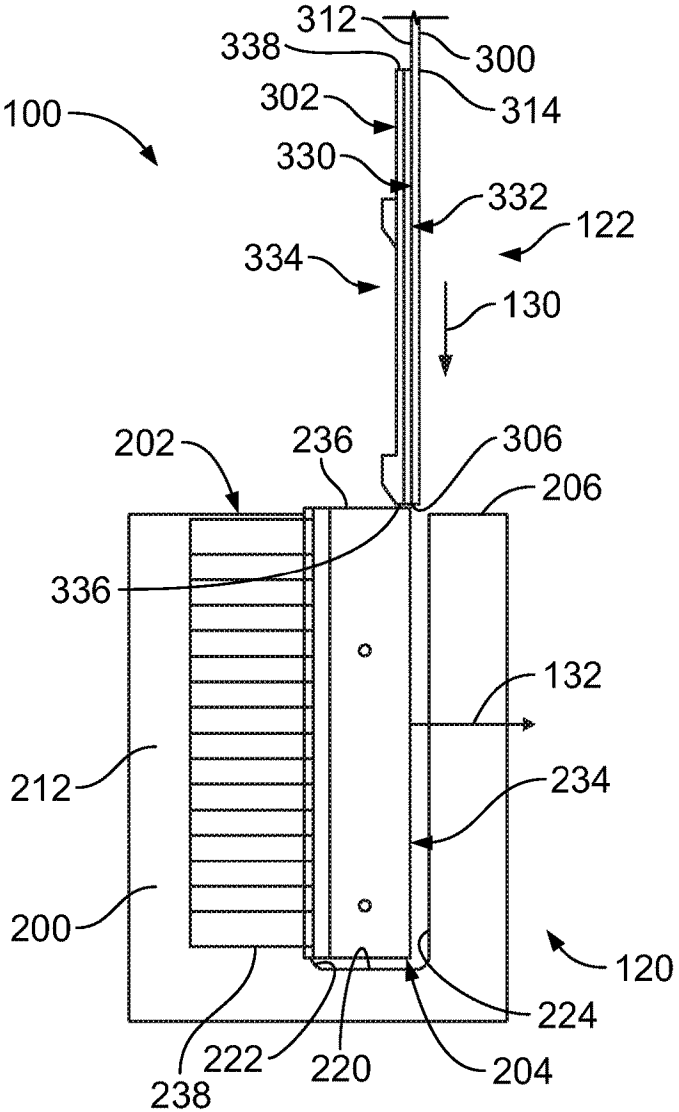
FIG. 3 is a top view of a portion of the communication system showing the first circuit card assembly poised for mating with the second circuit card assembly.
Figure 5:
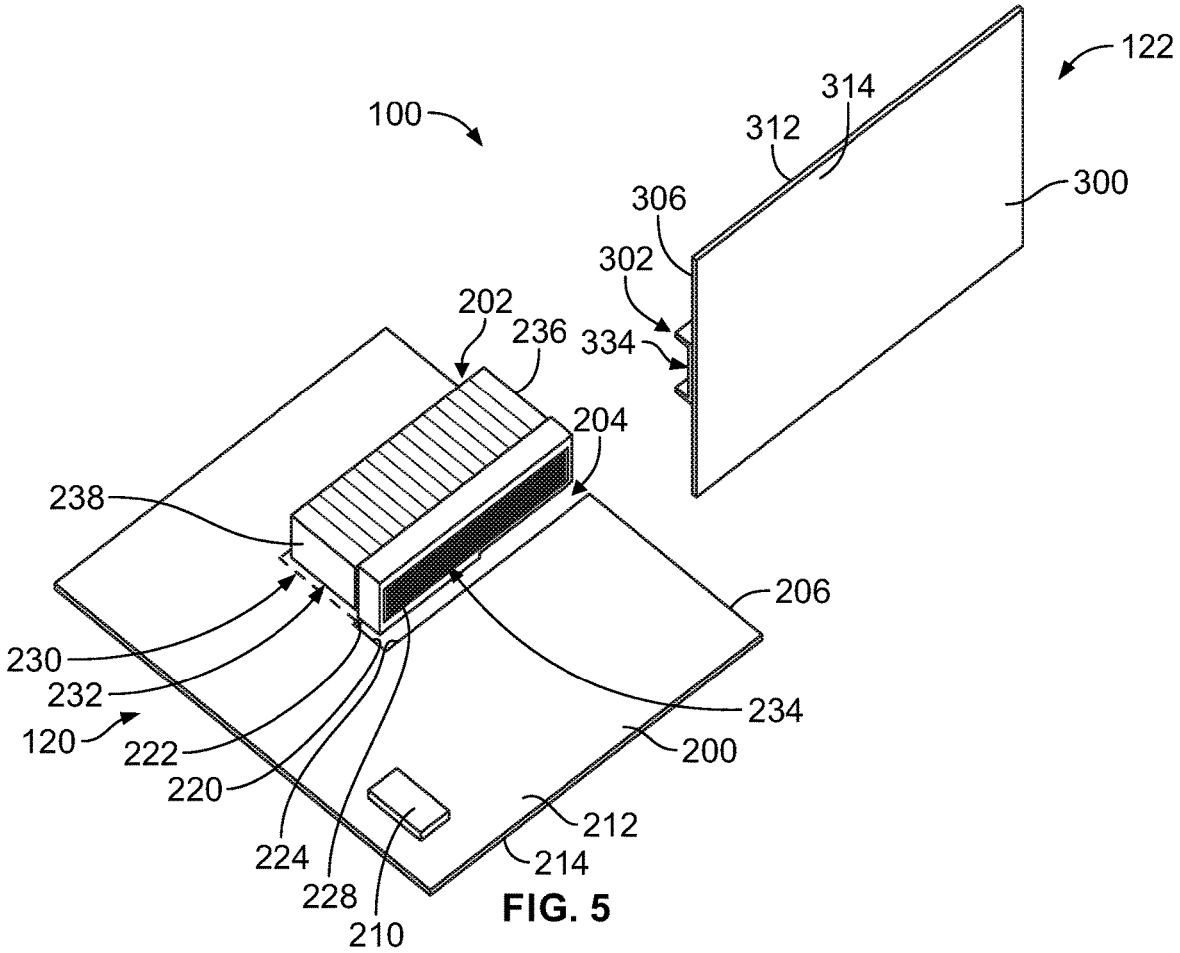
FIG. 5 is a perspective view of a portion of the communication system showing the first circuit card assembly and the second circuit card assembly poised for mating.

FIG. 2 is a perspective view of a portion of the communication system 100 showing the first circuit card assembly 120 coupled to the second circuit card assembly 122; however, it is noted that the first circuit card assembly 120 may be designed to be coupled to multiple circuit card assemblies and/or the second circuit card assembly 122 may be designed to be coupled to multiple circuit card assemblies, such as in the arrangement illustrated in FIG. 1. FIG. 3 is a top view of a portion of the communication system 100 showing the first circuit card assembly 120 poised for mating to the second circuit card assembly 122. FIG. 4 is a top view of a portion of the communication system 100 showing the first circuit card assembly 120 coupled to the second circuit card assembly 122. FIG. 5 is a perspective view of a portion of the communication system 100 showing the first circuit card assembly 120 and the second circuit card assembly 122 poised for mating.

The terms "first", "second", etc. are used merely as labels to generally identify components of the first circuit card assembly 120 or the second circuit card assembly 122, respectively; however, such labels are not used exclusively with the circuit card assemblies 120, 122. Either or both of the circuit card assemblies 120, 122 may include any of the various components or elements described herein and some components may only be described with respect to either the circuit card assembly 120 or the circuit card assembly 122; however, the other of the circuit card assembly 120 or the circuit card assembly 122 may additionally include such components. Furthermore, the components may be described herein with or without the "first" label or the "second" label.

The first circuit card assembly 120 includes the first PCB 200 having the first slot 204 and the electrical connector 202 mounted to the PCB 200 proximate to the first slot 204. The PCB 200 includes a first surface 212 and a second surface 214 being the main surfaces of the PCB 200. In the illustrated embodiment, the first surface 212 is an upper surface and the second surface 214 is a lower surface; however, the PCB 200 may have other orientations in alternative embodiments. The first and second surfaces 212, 214 extend along a primary axis 216 and a secondary axis 218 perpendicular to the primary axis 216. The PCB 200 has a thickness between the first and second surfaces 212, 214 along a transverse axis 217 perpendicular to the primary and secondary axes 216, 218. In an exemplary embodiment, the primary and secondary axes 216, 218 are in a horizontal plane and the transverse axis 217 extends in a vertical direction; however, the PCB 200 may have other orientations in alternative embodiments. In an exemplary embodiment, the primary axis 216 extends between the mating edge 206 and the rear edge 208 (shown in FIG. 1). In an exemplary embodiment, the secondary axis 218 is parallel to the mating edge 206.

The first slot 204 extends entirely through the PCB 200 between the first and second surfaces 212, 214. The first slot 204 is open at the mating edge 206 to receive the second circuit card assembly 122. The first slot 204 extends a length along the primary axis 216 to an end edge 220 (shown in FIGS. 4 and 5) remote from the mating edge 206. The first slot 204 has first and second side edges 222, 224 extending between the mating edge 206 and the end edge 220. Optionally, the side edges 222, 224 may be generally parallel to each other. Alternatively, the side edges 222, 224 may be nonparallel, such as to taper the first slot 204. For example, the first slot 204 may be wider near the mating edge 206 and narrower near the end edge 220. Optionally, the side edges 222, 224 may have chamfered lead-ins at the mating edge 206 to guide the second circuit card assembly 122 into the first slot 204.

The first PCB 200 includes a mounting area 230 for the electrical connector 202 on the first surface 212. The mounting area 230 is adjacent the first slot 204. For example, the mounting area 230 extends along the mating edge 206 a distance from the first slot 204 and extends along the first side edge 222 of the first slot 204 a distance from the mating edge 206. Optionally, the mounting area 230 may extend beyond the end edge 220 of the first slot 204. The electrical connector 202 is terminated to the PCB 200 at the mounting area 230. For example, contacts 228 that extend through the electrical connector 202 may be soldered to the PCB 200 at the mounting area 230. The mounting area 230 may include plated vias that receive compliant pins or solder tails of the contacts 228 of the electrical connector 202 for termination of the contacts 228 to the PCB 200. Optionally, at least a portion of the electrical connector 202 may extend beyond the first side edge 222 over the first slot 204 and/or at least a portion of the electrical connector 202 may extend forward of the mating edge 206 and/or at least a portion of the electrical connector 202 may extend rearward of the end edge 220. In other various embodiments, the PCB 200 may include more than one mounting area 230 adjacent the first slot 204 for receiving additional electrical connectors 202. For example, multiple electrical connectors 202 may be electrically connected to the same circuit card assembly 122. For example, additional electrical connectors 202 may be provided on both sides of the first slot 204 and/or both sides of the PCB 200.

The first electrical connector 202 is mounted to the PCB 200 at the mounting area 230. In the illustrated embodiment, the electrical connector 202 is a right angle connector having a mounting end 232 perpendicular to a mating end 234. For example, the mounting end 232 may be provided at a bottom of the electrical connector 202 and the mating end 234 may be provided at a side of the electrical connector 202. The electrical connector 202 extends between a front 236 and a rear 238 opposite the front 236. The mounting end 232 extends between the front 236 and the rear 238 at the bottom of the electrical connector 202. The mounting end 232 is mounted to the PCB 200. For example, the electrical connector 202 is mechanically and electrically terminated to the PCB 200 at the mounting end 232. The mating end 234 extends between the front 236 and the rear 238. In the illustrated embodiment, the mating end 234 generally faces the first slot 204 for interfacing with the second electrical connector 302 when the second circuit card assembly 122 is received in the first slot 204. The mating end 234 is configured to be mated to the mating electrical connector defined by the second electrical connector 302 when the second circuit card assembly 122 is received in the first slot 204.

In an exemplary embodiment, the mating end 234 is oriented generally vertically along the transverse axis 217 and extends parallel to the primary axis 216. The mating end 234 faces sideways rather than forward. For example, the mating end 234 is perpendicular to the mating edge 206 of the PCB 200. The front 236 is oriented generally vertically along the transverse axis 217 and extends parallel to the secondary axis 218. The front 236 may be positioned a first distance from the mating edge 206 (either forward of, rearward of or flush with the mating edge 206) and the rear 238 is positioned a second distance from the mating edge 206 greater than the first distance. The mating end 234 spans a majority of the distance between the front 236 and the rear 238. The front 236 is forward facing and, in the illustrated embodiment, is provided near the mating edge 206, such as generally flush with the mating edge 206.

The second circuit card assembly 122 includes the second PCB 300, which may or may not include a slot. In the illustrated embodiment, the PCB 300 does not include a slot. The PCB 300 includes a first surface 312 and a second surface 314 being the main surfaces of the PCB 300. In the illustrated embodiment, the first surface 312 defines a first side and the second surface 314 defines a second side of the PCB 300; however, the PCB 300 may have other orientations in alternative embodiments. The first and second surfaces 312, 314 extend along a primary axis 316 and a secondary axis 318 perpendicular to the primary axis 316. The PCB 300 has a thickness between the first and second surfaces 312, 314 along a transverse axis 317 perpendicular to the primary and secondary axes 316, 318. In an exemplary embodiment, the primary and secondary axes 316, 318 are in a vertical plane and the transverse axis 317 extends in a horizontal direction; however, the PCB 300 may have other orientations in alternative embodiments. In an exemplary embodiment, the primary axis 316 extends between the mating edge 306 and the rear edge 308 (shown in FIG. 1). In an exemplary embodiment, the secondary axis 318 is parallel to the mating edge 306.

In an exemplary embodiment, at least a portion of the PCB 300 is configured to be received in the first slot 204 that may at least partially fill the first slot 204. Such portion may engage the end edge 220, the first side edge 222 and/or the second side edge 224 of the first slot 204 when received therein.

The second PCB 300 includes a mounting area 330 for the electrical connector 302 on the first surface 312. The mounting area 330 extends from the mating edge 306 a distance. The electrical connector 302 is terminated to the PCB 300 at the mounting area 330. For example, contacts 328 of the electrical connector 302 may be soldered to the PCB 300 at the mounting area 330. The mounting area 330 may include plated vias that receive compliant pins or solder tails of the contacts 328 of the electrical connector 302 for termination of the contacts 328 to the PCB 300. Optionally, at least a portion of the electrical connector 302 may extend forward of the mating edge 306. In other various embodiments, the PCB 300 may include more than one mounting area 330 for receiving additional electrical connectors 302. For example, multiple electrical connectors 302 may be electrically connected to the same circuit card assembly 122.

The second electrical connector 302 is mounted to the PCB 300 at the mounting area 330. In the illustrated embodiment, the electrical connector 302 is a header connector having a mounting end 332 parallel to a mating end 334. For example, the mounting end 332 may be provided along one side of the electrical connector 302 and the mating end 334 may be provided at the opposite side of the electrical connector 302. Optionally, the mounting end 332 and the mating end 334 may be parallel to each other and non-coplanar. The electrical connector 302 extends between a front 336 (FIG. 3 and a rear 338 (FIG. 3) opposite the front 336. The mounting end 332 and the mating end 334 both extend between the front 336 and the rear 338. The mounting end 332 is mounted to the PCB 300. For example, the electrical connector 302 is mechanically and electrically terminated to the PCB 300 at the mounting end 332. In the illustrated embodiment, the mating end 334 is oriented for interfacing with the first electrical connector 202 when the second circuit card assembly 122 is received in the first slot 204.

In an exemplary embodiment, the mating end 334 is oriented generally vertically and extends parallel to the primary axis 316. The mating end 334 faces sideways rather than forward. For example, the mating end 334 is perpendicular to the mating edge 306 of the PCB 300. The front 336 is oriented generally vertically and extends parallel to the secondary axis 318. The front 336 may be positioned a first distance from the mating edge 306 (either forward of, rearward of or flush with the mating edge 306) and the rear 338 is positioned a second distance from the mating edge 306 greater than the first distance. The mating end 334 spans a majority of the distance between the front 336 and the rear 338. The front 336 is forward facing and, in the illustrated embodiment, is provided near the mating edge 306, such as generally flush with the mating edge 306.

When the first and second circuit card assemblies 120, 122 are mated, the first and second PCBs 200, 300 are internested and the second PCB 300 is received in the first slot 204. When mated, the first PCB 200 at least partially overlaps with the second PCB 300 to align the mating ends 234, 334 of the electrical connectors 202, 302. For example, the mating edges 206, 306 bypass each other as the second PCB 300 is received in the first slot 204. During mating, the contacts 328 are moved in a board loading direction 130 (for example, parallel to the primary axis 316 of the PCB 300) and the contacts 228 are moved in a connector mating direction 132 (for example, sideways or perpendicular to the board loading direction 130) as the first and second electrical connectors 202, 302 are mated. For example, a portion of the first electrical connector 202 is moved toward the second electrical connector 302.

Figure 6:
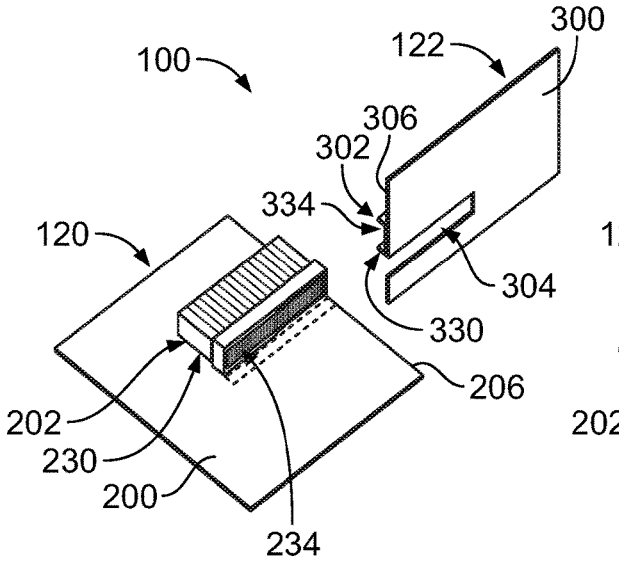
FIG. 6 is a perspective view of a portion of the communication system in accordance with an exemplary embodiment.

FIG. 6 is a perspective view of a portion of the communication system 100 in accordance with an exemplary embodiment. FIG. 6 shows the second circuit card assembly 122 with the second slot 304 and the first circuit card assembly 120 without the first slot 204 (shown in FIG. 5). Optionally, at least a portion of the first PCB 200 is configured to at least partially fill the second slot 304. The second electrical connector 302 is mounted to the mounting area 330 adjacent the second slot 304. When the first and second circuit card assemblies 120, 122 are mated, the first and second PCBs 200, 300 are internested with the first PCB 200 being received in the second slot 304. When mated, the first PCB 200 at least partially overlaps with the second PCB 300 to align the mating ends 234, 334 of the electrical connectors 202, 302. For example, the mating edges 206, 306 bypass each other as the first PCB 200 is received in the second slot 304.

Figure 7:
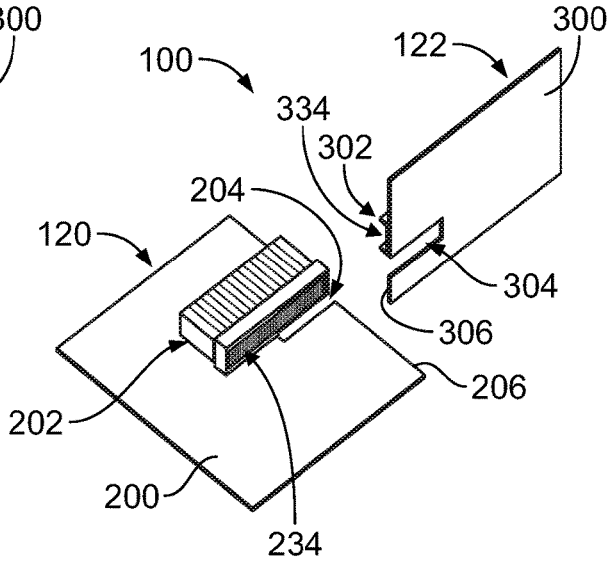
FIG. 7 is a perspective view of a portion of the communication system in accordance with an exemplary embodiment.

FIG. 7 is a perspective view of a portion of the communication system 100 in accordance with an exemplary embodiment. FIG. 7 shows the first circuit card assembly 120 with the first slot 204 and the second circuit card assembly 122 with the second slot 304. When the first and second circuit card assemblies 120, 122 are mated, the first and second PCBs 200, 300 are internested with the first PCB 200 being received in the second slot 304 and with the second PCB 300 being received in the first slot 204. When mated, the first PCB 200 at least partially overlaps with the second PCB 300 to align the mating ends 234, 334 of the electrical connectors 202, 302. For example, the mating edges 206, 306 bypass each other as the PCBs 200, 300 are received in the second and first slots 304, 204, respectively.

Figure 8:
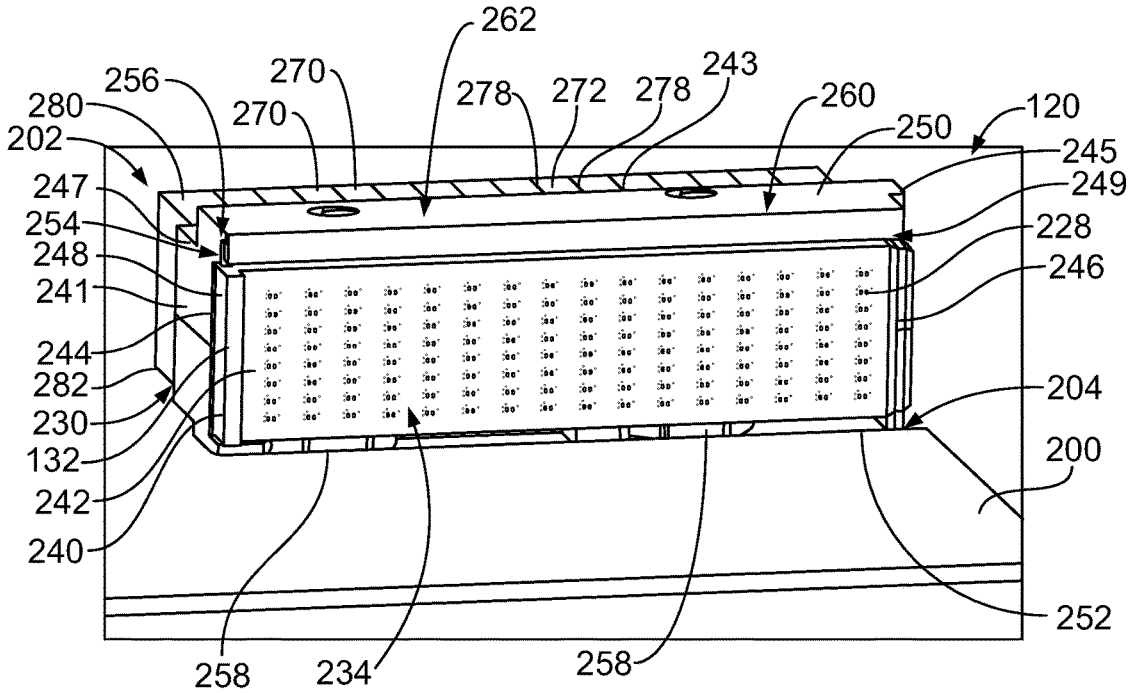
FIG. 8 is a top perspective view of a portion of the first circuit card assembly showing the first electrical connector mounted to a first PCB.
Figure 9:
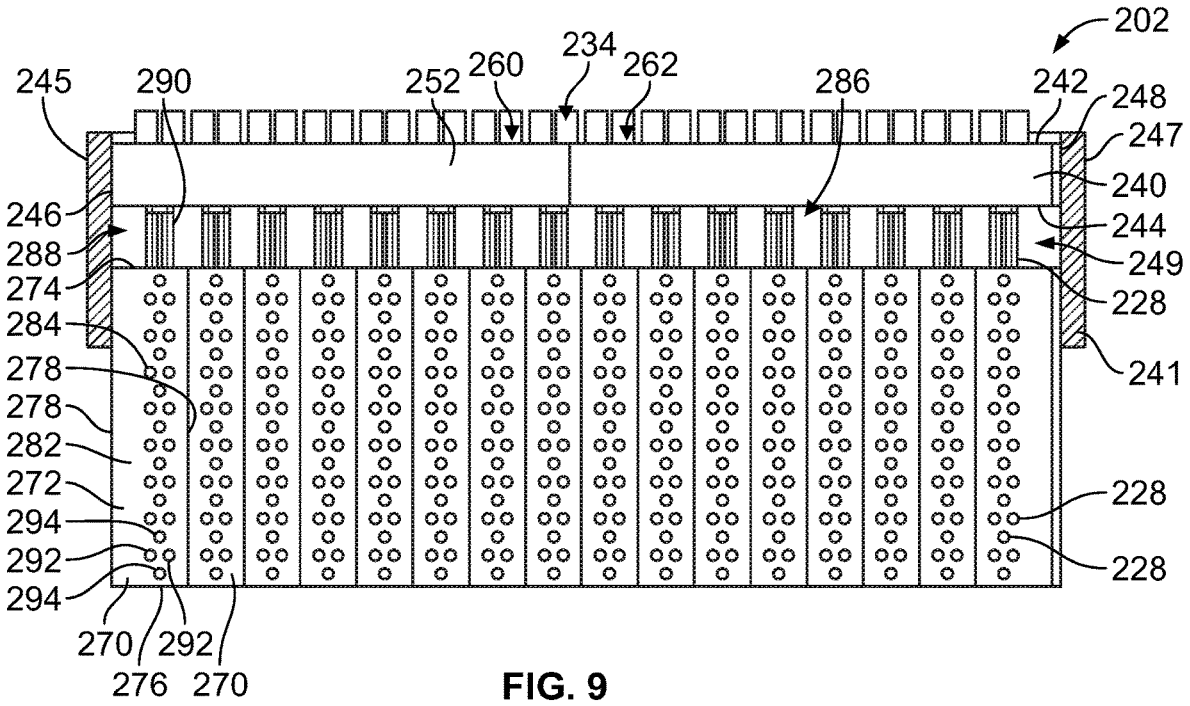
FIG. 9 is a bottom view of a first electrical connector of the first circuit card assembly in accordance with an exemplary embodiment.
Figure 10:
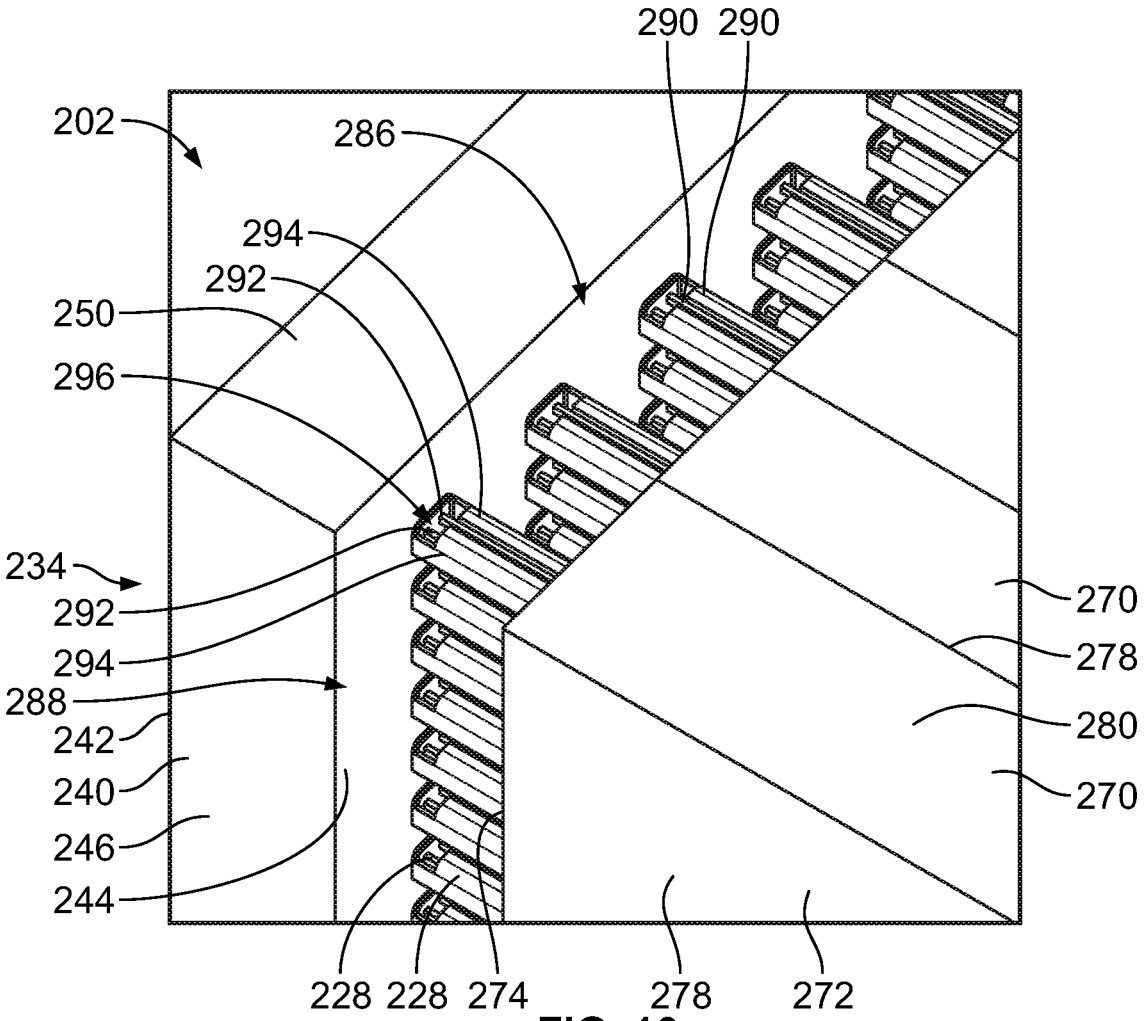
FIG. 10 is a perspective view of a portion of the first electrical connector in accordance with an exemplary embodiment.
Figure 11:
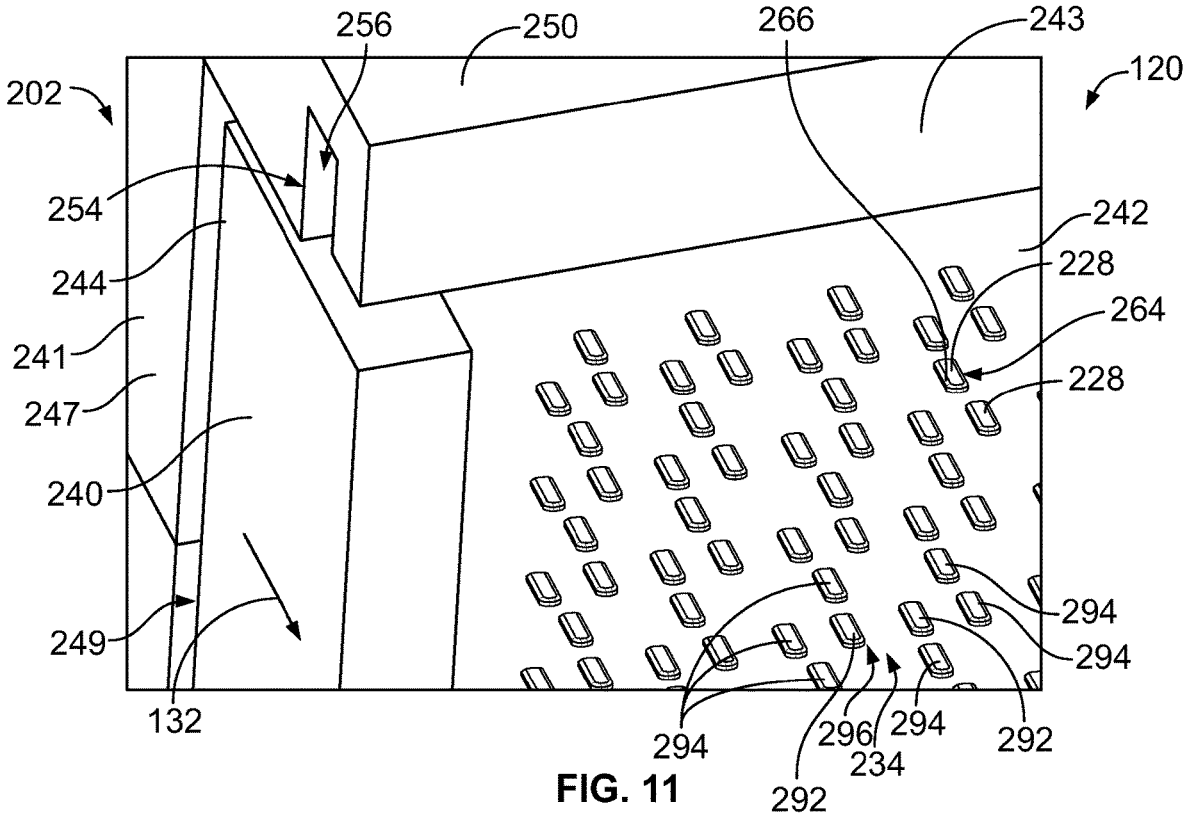
FIG. 11 is an end view of a portion of the first electrical connector in accordance with an exemplary embodiment.

FIG. 8 is a side perspective view of the first electrical connector 202 in accordance with an exemplary embodiment. FIG. 9 is a bottom view of the first electrical connector 202 in accordance with an exemplary embodiment. FIG. 10 is a perspective view of a portion of the first electrical connector 202 in accordance with an exemplary embodiment. FIG. 11 is a side perspective view of a portion of the first electrical connector 202 in accordance with an exemplary embodiment.

In an exemplary embodiment, the first electrical connector 202 includes a mating housing 240 at the mating end 234 and a receptacle housing 241 (shown in cross section in FIG. 9 and removed in FIG. 10 to illustrate other components) surrounding at least a portion of the mating housing 240. The mating housing 240 is movable within the receptacle housing 241, such as in the connector mating direction 132. Such movement allows mating of the first contacts 228 with the second contacts 328 (see FIG. 13) of the second electrical connector 302.

The mating housing 240 includes a first side 242, a second side 244, a front 246 and a rear 248. The first side 242 defines the mating end 234 of the electrical connector 202. The mating end 234 is oriented perpendicular to the first PCB 200. In an exemplary embodiment, the mating housing 240 holds the contacts 228 for mating with the second electrical connector 302 (shown in FIG. 2). For example, each of the contacts 228 includes a mating end 264 (FIG. 11) extending beyond the first side 242 for mating with the second electrical connector 302. The mating ends 264 are provided at the first side 242 in a predetermined layout for mating with the second electrical connector 302. The mating ends 264 have mating interfaces 266 (FIG. 11) configured to engage the mating contact 328 (shown in FIG. 13) when mated thereto. Other types of mating ends may be provided in alternative embodiments, such as spring beams, pins, sockets, and the like.

The receptacle housing 241 includes end walls 243 extending between a front wall 245 and a rear wall 247. The walls 243, 245, 247 define a cavity 249 that receives the mating housing 240. In an exemplary embodiment, the end walls 243 are provided at a top 250 and a bottom 252 of the first electrical connector 202. In an exemplary embodiment, the first electrical connector 202 include connecting elements 254 (FIG. 11) at the top 250 and the bottom 252 for connecting the first electrical connector 202 to the second electrical connector 302. In the illustrated embodiment, the connecting elements 254 are defined by grooves 256 in the receptacle housing 241 at the top 250 and the bottom 252 configured to receive portions of the second electrical connector 302. The connecting elements 254 secure the receptacle housing 241 to the second electrical connector 302 as the electrical connectors 202, 302 are coupled together (for example, as the PCBs 200, 300 are moved in the board loading direction). Other types of connecting elements 254 may be provided in alternative embodiments, such as pins, clips, fasteners, and the like.

The electrical connector 202 includes drive members 258 (FIG. 8) at the top 250 and the bottom 252 for actuating the mating housing 240 relative to the receptacle housing 241 during mating. The drive members 258 may be positioned in the cavity 249, such as at the end wall(s) 243 at the top 250 and/or at the bottom 252. The drive members 258 are operably coupled to the receptacle housing 241 and operably coupled to the mating housing 240. As the drive members 258 are operated, the drive members 258 move the mating housing 240 sideways relative to the receptacle housing 241 in the connector mating direction 132. In an exemplary embodiment, the drive members 258 may be actuated by engagement with the second electrical connector 302 as the first and second electrical connectors 302 are coupled together. For example, actuators, such as ramps, may be provided on the second electrical connector 302 to actuate the drive members 258 as the drive members engage the actuators. In an exemplary embodiment, multiple drive members 258 are provided, such as at a front section 260 and a rear section 262 of the electrical connector 202. More than two drive members 258 may be provided along either or both sides of the electrical connector 202. In an exemplary embodiment, the drive members 258 are cam levers and may be referred to hereinafter as cam levers 258. However, other types of drive members 258 may be provided in alternative embodiments, such as cam pins configured to be received in cam sockets, pinions configured to engage a rack, a crank configured to engage a rack, a crank configured to engage an idler gear, one or more linkages configured to engage an actuator, and the like.

In an exemplary embodiment, the electrical connector 202 includes contact modules 270 each holding a plurality of the contacts 228. The contact modules 270 may be coupled to the receptacle housing 241 and/or the mating housing 240, such as at the second side 244. For example, in the illustrated embodiment, the contact modules 270 are loaded into the receptacle housing 241 behind the mating housing 240. In an exemplary embodiment, each contact module 270 includes a dielectric body 272 holding corresponding contacts 228. For example, the dielectric body 272 may be overmolded around portions of the contacts 228. Optionally, the contact modules 270 may include ground shields (not shown) to provide electrical shielding for the contacts 228.

The contact modules 270 each have a first side 274 facing the mating housing 240 and a second side 276 opposite the first side 274. The contact module 270 includes sides 278 facing each other when the contact modules 270 are stacked front to rear within the electrical connector 202. Any number of the contact modules 270 may be stacked together depending on the particular application. The number of contacts 228 within the electrical connector 202 may be increased or decreased by changing the number of contact modules 270 rather than retooling to increase the number of contacts per contact module, as is common in conventional systems, such retooling being expensive. The contact module 270 includes a top 280 and a bottom 282. The bottom 282 is configured to be mounted to the first PCB 200 (FIG. 8). Optionally, portions of the contacts 228 may extend below the bottom 282 for termination to the first PCB 200. For example, each of the contacts 228 may include a terminating end 284 (FIG. 9) configured to be terminated to the first PCB 200. For example, the terminating end 284 may be a compliant pin, such as an eye of the needle pin, configured to be press-fit into plated vias in the first PCB 200. In other various embodiments, the terminating end 284 may be a solder tail or another type of terminating end.

In an exemplary embodiment, the electrical connector 202 includes a compliant section 286 between the contact modules 270 and the mating housing 240 that allows the mating housing 240 to shift relative to the contact modules 270, such as during mating with the second electrical connector 302. For example, the contact modules 270 may not engage the mating housing 240 in various embodiments. Rather, a gap 288 may be provided between the first sides 274 of the contact modules 270 and the second side 244 of the mating housing 240. The contacts 228 may span the gap 288 between the contact modules 270 and the mating housing 240. The contacts 228 include flexible sections 290 between the mating ends 264 and the terminating ends 284 to allow relative movement of the contacts 228 and the mating housing 240. The flexible sections 290 may be defined by sections of the contacts 228 that are not encased or enclosed by the dielectric body 272 and/or do not extend through the mating housing 240. For example, the flexible sections 290 may be located in the gap 288. Optionally, the flexible sections 290 may be enclosed or shrouded by a portion of the electrical connector 202, such as a shroud extending from the second side 244 of the mating housing 240 or a separate housing component.

In an exemplary embodiment, the contacts 228 include signal contacts 292 and ground contacts 294. Optionally, the signal contacts 292 may be arranged in pairs 296 configured to convey differential signals. The ground contacts 294 are interspersed with the signal contacts 292 to provide electrical shielding for the signal contacts 292. For example, the ground contacts 294 may be provided between the pairs 296 of signal contacts 292. Optionally, the ground contacts 294 may be provided above, below, and/or between the various pairs 296 of signal contacts 292. The signal contacts 292 and/or the ground contacts 294 may be stamped and formed contacts.

As shown in FIG. 8, the bottoms 282 of the contact modules 270 are mounted to the PCB 200. In an exemplary embodiment, the mating housing 240 is positioned above the first slot 204 for mating with the second electrical connector 302 (shown in FIG. 2). In an exemplary embodiment, the mating housing 240 is movable relative to the PCB 200 and the contact modules 270, which are fixed to the PCB 200. For example, the flexible sections 290 of the contacts 228 defining the compliant section 286 of the electrical connector 202 allow the mating housing 240 to move relative to the PCB 200 during mating with the second electrical connector 302.

Figure 12:
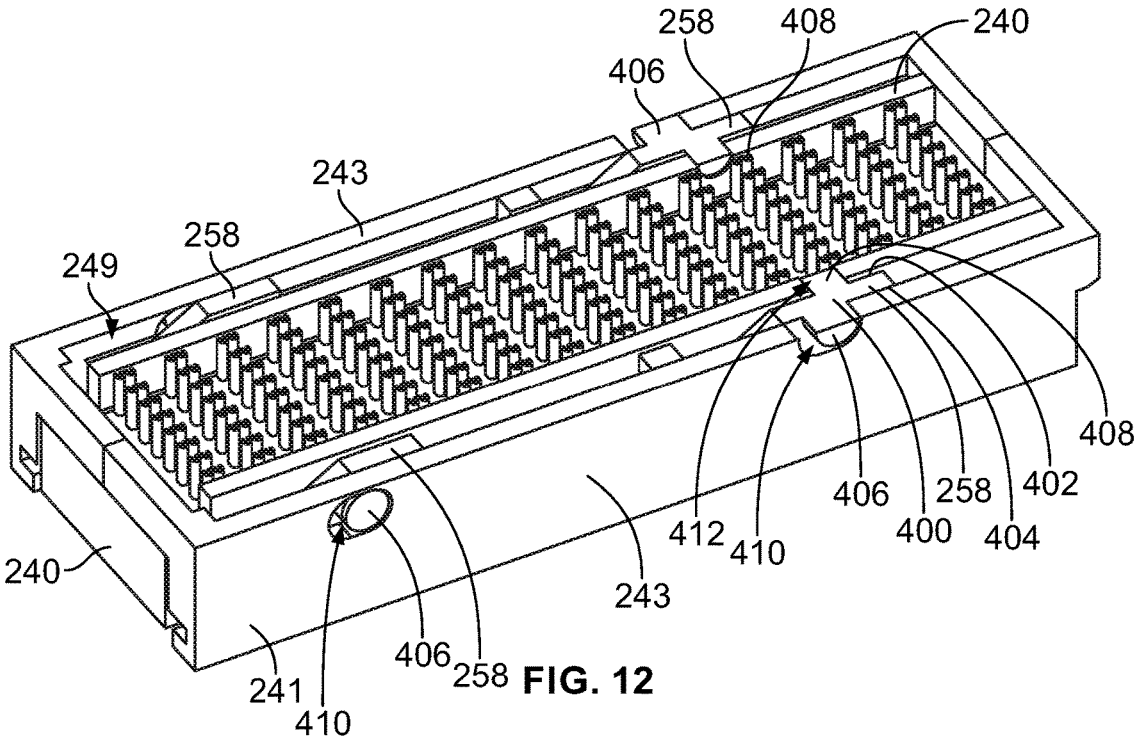
FIG. 12 is a partial sectional view of a portion of the first electrical connector in accordance with an exemplary embodiment.

FIG. 12 is a rear perspective, partial sectional view of a portion of the first electrical connector 202. FIG. 12 shows the mating housing 240 positioned in the cavity 249. The drive members 258 are positioned between the mating housing 240 and the receptacle housing 241. In the illustrated embodiment, the drive members 258 are cam levers having a body 400 extending between a first side 402 and a second side 404. The cam levers 258 includes a fixed pivot 406 extending from the second side 404 and a movable pivot 408 extending from the first side 402. The fixed pivot 406 is received in an elongated slot 410 in the corresponding end wall 243 of the receptacle housing 241. The movable pivot 408 is received in an opening 412 in the mating housing 240. The cam levers 258 are pivotable about the fixed pivot 406 to cause the movable pivot 408 to move relative to the receptacle housing 241. As the movable pivot 408 moves relative to the receptacle housing 241, the mating housing 240 moves relative to the receptacle housing 241 in the connector mating direction 132.

Figure 13:
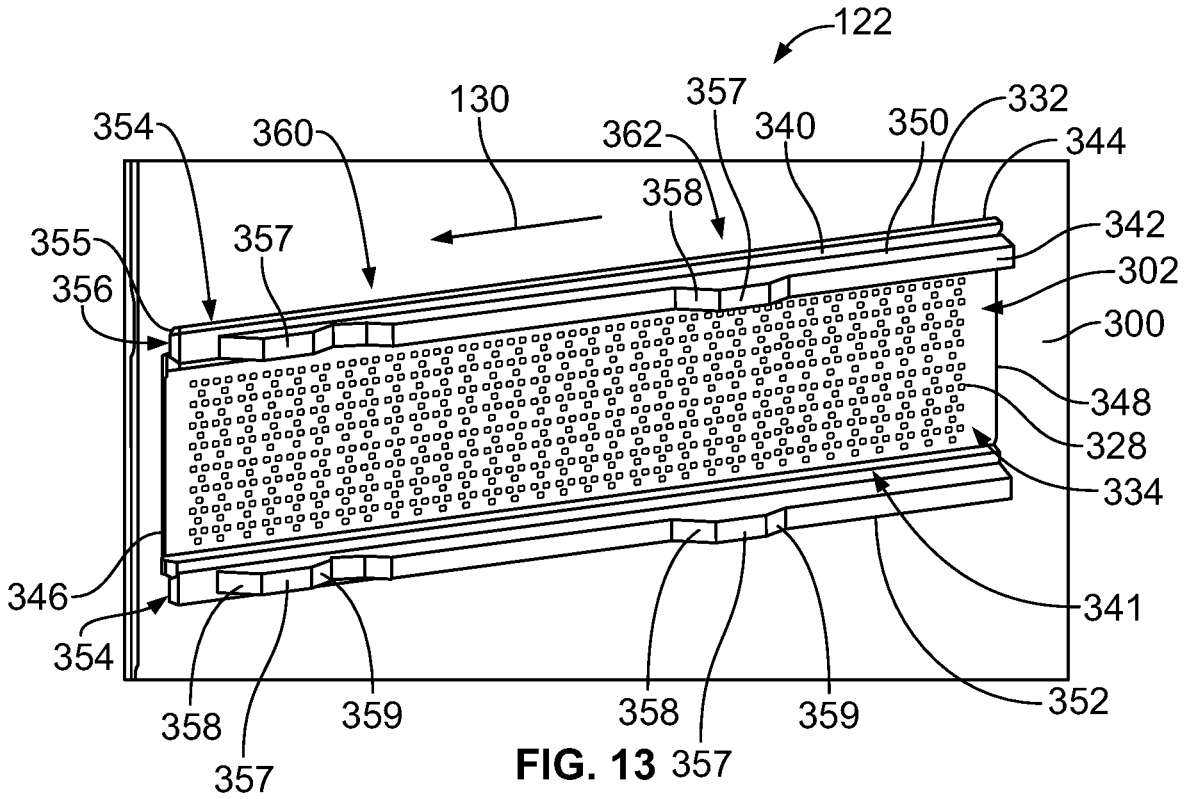
FIG. 13 is a perspective view of a portion of the second circuit card assembly in accordance with an exemplary embodiment.
Figure 14:
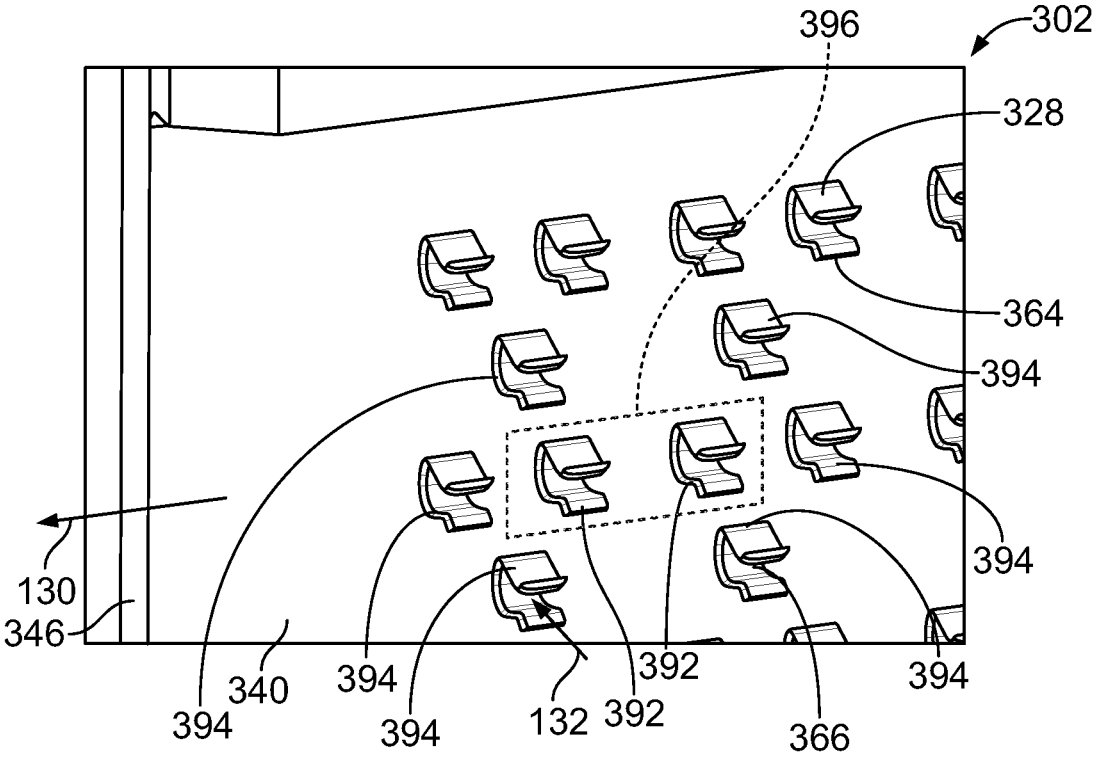
FIG. 14 is a perspective view of a portion of the second electrical connector in accordance with an exemplary embodiment.

FIG. 13 is a perspective view of a portion of the second circuit card assembly 122 in accordance with an exemplary embodiment. FIG. 14 is a perspective view of a portion of the second electrical connector 302 in accordance with an exemplary embodiment. In an exemplary embodiment, the electrical connector 302 includes a header housing 340 holding the contacts 328. The header housing 340 includes walls defining a cavity 341 configured to receive the mating housing 240 of the first electrical connector 202 (both shown in FIG. 8).

The header housing 340 includes a first side 342, a second side 344, a front 346 and a rear 348. The first side 342 defines the mating end 334 of the electrical connector 302. The mating end 334 is oriented parallel to the second PCB 300. In an exemplary embodiment, the header housing 340 holds the contacts 328 for mating with the first electrical connector 202. For example, each of the contacts 328 includes a mating end 364 (FIG. 14) exposed at or beyond the first side 342 for mating with the first electrical connector 202. The mating ends 364 are provided at the first side 342 in a predetermined layout for mating with the first electrical connector 202. The mating ends 364 have mating interfaces 366 for electrical connection with the first contacts 228.

The header housing 340 includes a top 350 and a bottom 352. In an exemplary embodiment, the top 350 and the bottom 352 include connecting elements 354 for connecting the second electrical connector 302 to the first electrical connector 202. In the illustrated embodiment, the connecting elements 354 include pockets 356 defined by ledges 355 at the top 350 and the bottom 352. The pockets 356 are configured to receive corresponding connecting elements 254 (shown in FIG. 8) of the receptacle housing 241 of the first electrical connector 202. The ledges 355 are configured to be received in corresponding grooves 256 (shown in FIG. 8). Other types of connecting elements 354 may be provided in alternative embodiments, such as pins, clips, fasteners, and the like.

The header housing 340 includes actuators 357 at the first side 342 configured to actuate the drive members 258 (shown in FIG. 8). In the illustrated embodiment, the actuators 357 include ramp surfaces 358 and return ramp surfaces 359 that engage the drive members 258 and actuate the drive members 258 as the drive members 258 ride along the header housing 340 during mating of the first and second electrical connectors 202, 302 in the board loading direction 130. In the illustrated embodiment, the header housing 340 includes multiple actuators 357 laterally spaced apart, such as for actuating multiple drive members 258. For example, the header housing 340 may include actuators 357 along both the top 350 and the bottom 352 at both a front section 360 and a rear section 362 of the header housing 340. Optionally, the actuators 357 may be at different heights, such as shorter at the front section 360 and taller at the rear section 362 to allow actuation of different drive members 258. Optionally, the actuators 357 may be staggered within the cavity such as closer in or further out to align with corresponding staggered drive members 258.

The header housing 340 defines the mounting end 332 of the electrical connector 302 configured to be mounted to the PCB 300. Optionally, portions of the contacts 328 may extend beyond the mounting end 332 for termination to the PCB 300. For example, the contacts 328 may include terminating ends (not shown), such as compliant pins, solder tails, and the like, configured to be terminated to the PCB 300.

In an exemplary embodiment, such as shown in FIG. 14, the contacts 328 include signal contacts 392 and ground contacts 394. Optionally, the signal contacts 392 may be arranged in pairs 396 configured to convey differential signals (differential pairs of signal contacts); however, the signal contacts 392 may convey single-ended signals rather than differential signals. The ground contacts 394 are interspersed with the signal contacts 392 to provide electrical shielding for the signal contacts 392. For example, the ground contacts 394 may be provided between the pairs 396 of signal contacts 392.

Figure 15:
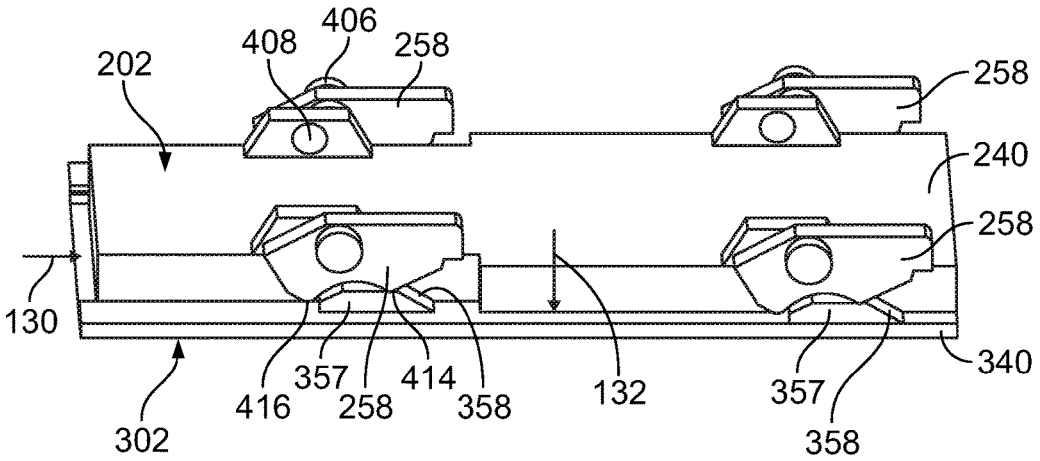
FIG. 15 illustrates a portion of the communication system showing a portion of the first electrical connector mated with the second electrical connector.

FIG. 15 illustrates a portion of the communication system 100 showing a portion of the first electrical connector 202 mated with the second electrical connector 302. FIG. 15 shows the mating housing 240 of the first electrical connector 202 and the cam levers 258 of the first electrical connector 202 mated with the header housing 340 of the second electrical connector 302. The cam levers 258 engage corresponding actuators 357 when the first electrical connector 202 is coupled to the second electrical connector 302. For example, as the first electrical connector slides into the second electrical connector 302 in the board loading direction 130, the cam levers 258 slide along the ramp surfaces 358 of the actuators 357 causing the cam levers 258 to rotate. Rotation of the cam levers 258 causes movement of the mating housing 240 in the connector mating direction 132 to electrically connect the first contacts 228 and the second contacts 328.

Figure 16:
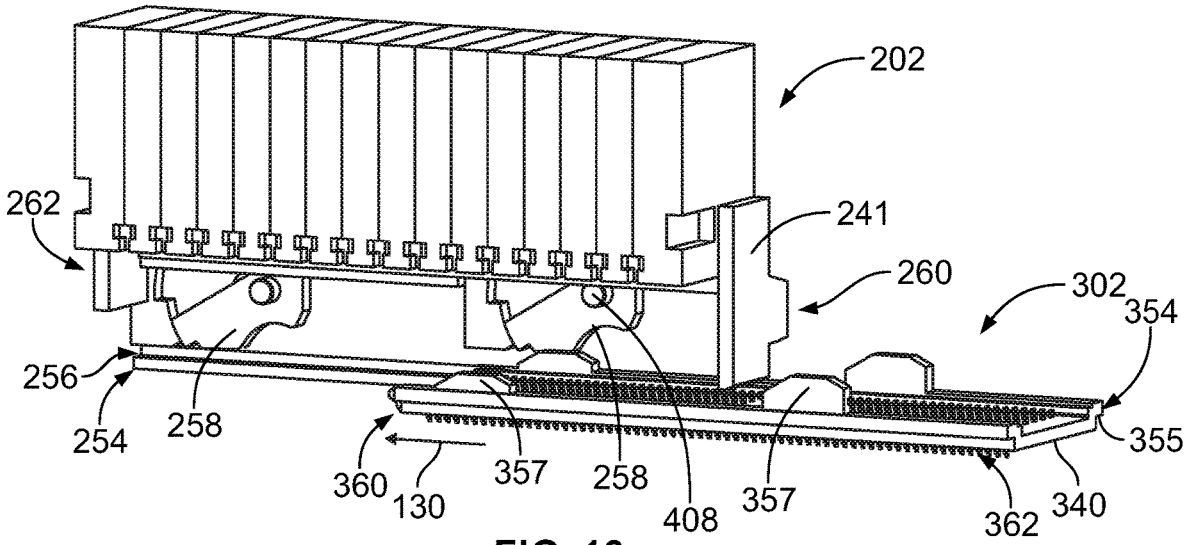
FIG. 16 is a top perspective, partial sectional view of a portion of the communication system showing a portion of the first electrical connector partially mated with the second electrical connector.

FIG. 16 is a top perspective, partial sectional view of a portion of the communication system 100 showing a portion of the first electrical connector 202 partially mated with the second electrical connector 302. During mating, the second electrical connector 302 is slid forward in the board loading direction 130 with the second PCB 300 into the slot 204 (shown in FIG. 8) in the first PCB 200 (shown in FIG. 8). The connecting elements 254 of the first electrical connector 202 to engage the connecting elements 354 of the second electrical connector 302. For example, the ledge 355 is received in the groove 256. A portion of the receptacle housing 241 is captured in the groove 356 behind the ledge 355.

As such, the receptacle housing 241 is fixedly coupled to the header housing 340. As the header housing 340 is slid forward in the board loading direction 130, the actuators 357 are configured to interact with the cam levers 258. In an exemplary embodiment, the actuators 357 are at different heights. For example, the actuator 357 at the front section 360 is shorter and the actuator 357 at the rear section 362 is taller. Optionally, the cam levers 258 may be staggered. For example, the cam lever 258 at the front section 260 is positioned further from the first side 242 and the cam lever 258 at the rear section 262 is positioned closer to the first side 242 (FIG. 8). As such, the actuator 357 at the front section 360 does not interact with or actuate the cam lever 258 at the rear section 262 as the header housing 340 passes through the receptacle housing 241.

Figure 17:
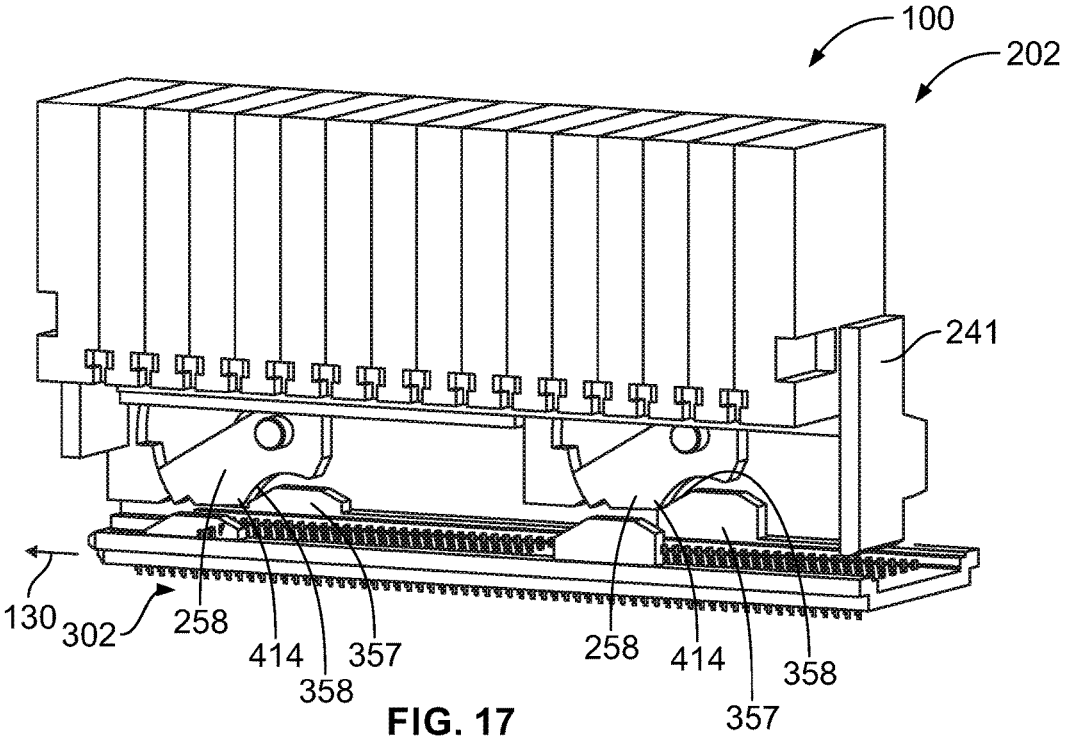
FIG. 17 is a top perspective, partial sectional view of a portion of the communication system showing a portion of the first electrical connector partially mated with the second electrical connector.

FIG. 17 is a top perspective, partial sectional view of a portion of the communication system 100 showing a portion of the first electrical connector 202 partially mated with the second electrical connector 302. FIG. 17 illustrates the first and second electrical connectors 202, 302 immediately before actuation of the cam levers 258. The actuators 357 are illustrated immediately prior to engaging the cam levers 258. In an exemplary embodiment, the cam levers 258 include cam surfaces 414 configured to engage the actuators 357. The cam surfaces 414 are configured to ride along the ramp surfaces 358 as the header housing 340 is slid forward in the board loading direction 130.

Figure 18:
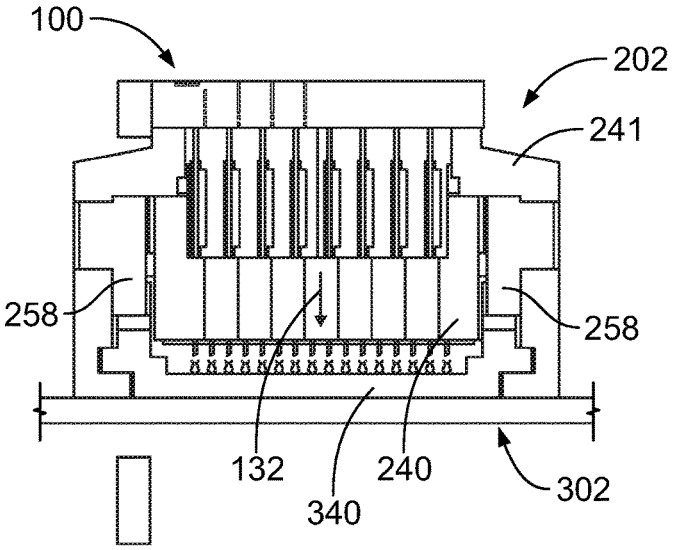
FIG. 18 is a cross-sectional view of a portion of the connector system showing a portion of the first electrical connector partially mated with the second electrical connector.
Figure 19:
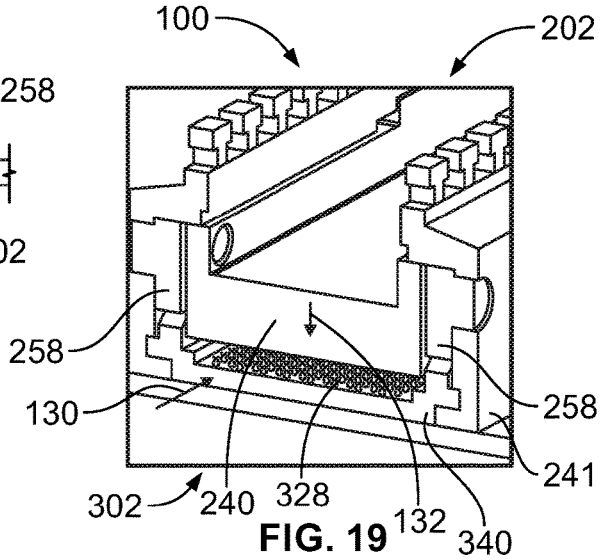
FIG. 19 is a perspective, partial sectional view of a portion of the connector system showing a portion of the first electrical connector partially mated with the second electrical connector.

FIG. 18 is a cross-sectional view of a portion of the communication system 100 showing a portion of the first electrical connector 202 partially mated with the second electrical connector 302. FIG. 19 is a perspective, partial sectional view of a portion of the communication system 100 showing a portion of the first electrical connector 202 partially mated with the second electrical connector 302. FIGS. 18 and 19 illustrates the first electrical connector 202 positioned prior to actuation of the cam levers 258. The mating housing 240 is elevated and separated from the header housing 340. The cam levers 258 hold the mating housing 240 in a clearance position to allow the header housing 340 and the second contacts 328 to be loaded into the first electrical connector 202 in the board loading direction 130.

Figure 20:
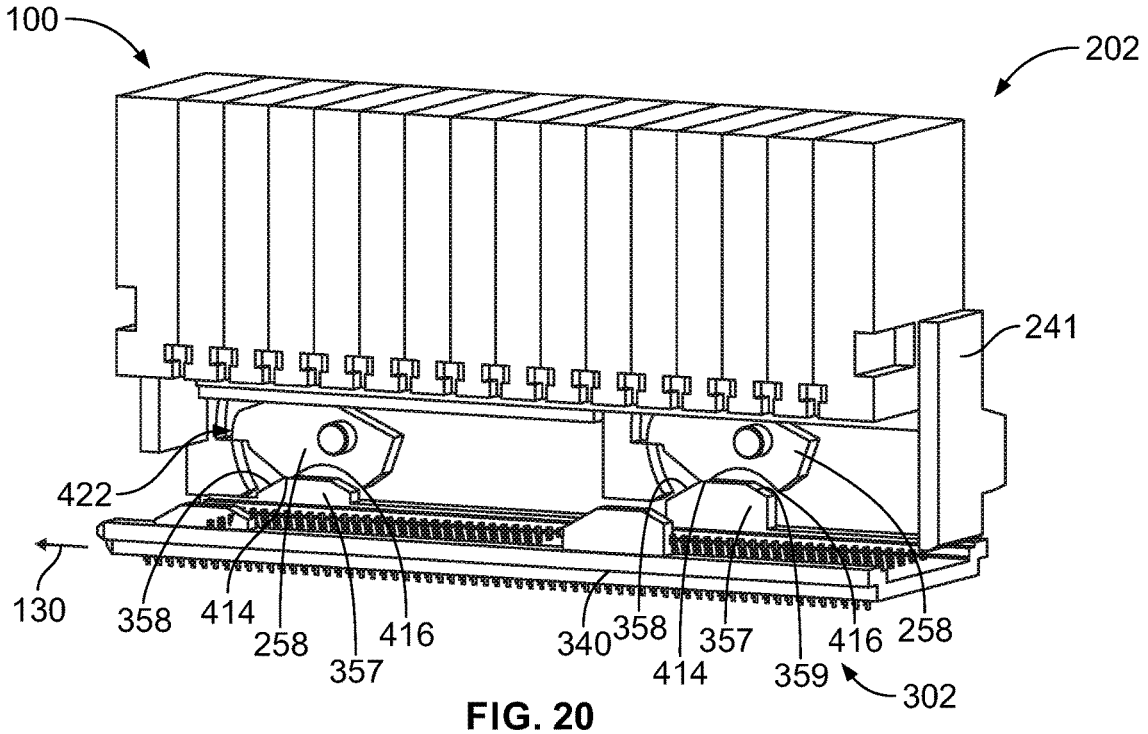
FIG. 20 is a top perspective, partial sectional view of a portion of the communication system showing a portion of the first electrical connector mated with the second electrical connector.
Figure 21:
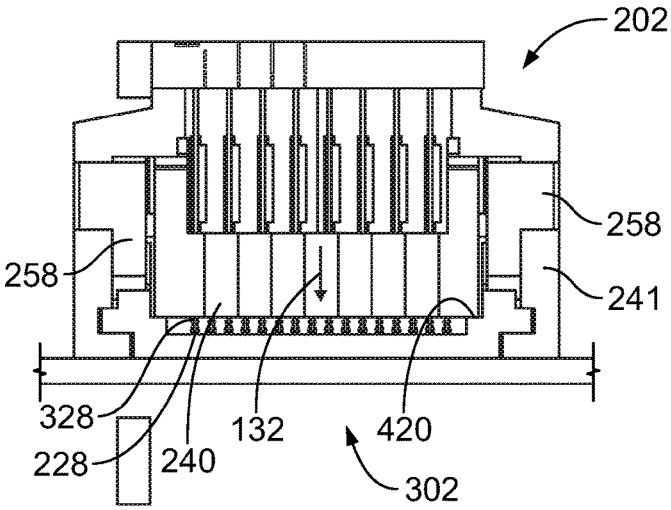
FIG. 21 is a cross-sectional view of a portion of the connector system showing a portion of the first electrical connector mated with the second electrical connector.
Figure 22:
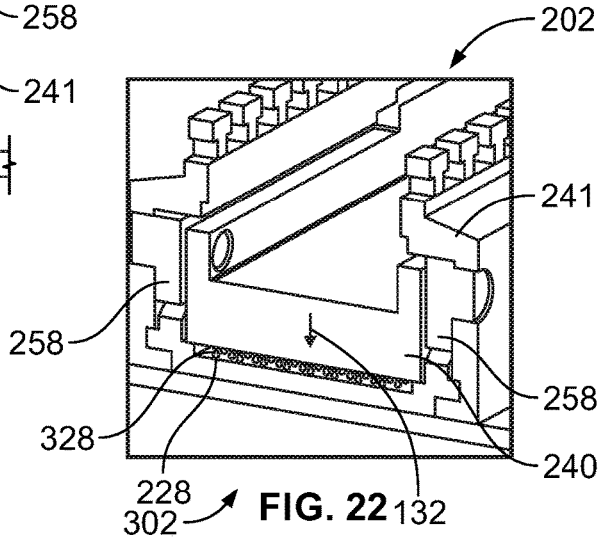
FIG. 22 is a perspective, partial sectional view of a portion of the connector system showing a portion of the first electrical connector mated with the second electrical connector.

FIG. 20 is a top perspective, partial sectional view of a portion of the communication system 100 showing a portion of the first electrical connector 202 mated with the second electrical connector 302. FIG. 21 is a cross-sectional view of a portion of the communication system 100 showing a portion of the first electrical connector 202 mated with the second electrical connector 302. FIG. 22 is a perspective, partial sectional view of a portion of the communication system 100 showing a portion of the first electrical connector 202 mated with the second electrical connector 302. FIGS. 20-22 illustrates the first and second electrical connectors 202, 302 after actuation of the cam levers 258.

The actuators 357 are illustrated engaged with the cam levers 258. During mating, the cam surfaces 414 ride along the ramp surfaces 358 of the actuators 357 to rotate the cam levers 258. As the cam levers 258 rotate, the movable pivots 408 are pivoted and moved toward the header housing 340 in the connector mating direction 132. During mating, the mating housing 240 is driven toward the header housing 340 in the connector mating direction 132 to mate the first contacts 228 and the second contacts 328. In an exemplary embodiment, the header housing 340 includes stop surfaces 420 that stop mating of the mating housing 240 with the header housing 340. The header housing 340 is driven in the board loading direction 130 until fully mated, Once the cam surfaces 414 clear the ramp surfaces 358, the cam levers 258 are no longer rotated. Further travel of the header housing 340 causes the cam surfaces 414 to ride along the flat edge of the actuator 357 without further rotation of the cam levers 258. Optionally, the header housing 340 may bottom out against the first electrical connector 202, such as against the mating housing 240.

Over travel of the header housing 340 in the board loading direction 130 causes the mating housing 240 and the cam levers 258 to move forward with the header housing 340. The slot 410 in the receptacle housing 241 is elongated to allow the fixed pivots 406 to slide in the elongated slots 410. Optionally, the receptacle housing 241 may include pockets 422 that receive portions of the cam levers 258 during over travel. During unmating of the first and second electrical connectors 202, 302, a return cam surface 416 of the cam lever 258 engages the return ramp surface 359 of the actuator 357 to rotate the cam lever 258 in the opposite direction causing the mating housing 240 to move away from the header housing 340. The header housing 340 may then be pulled out of the first electrical connector 202 during the unmating process.

Figure 23:
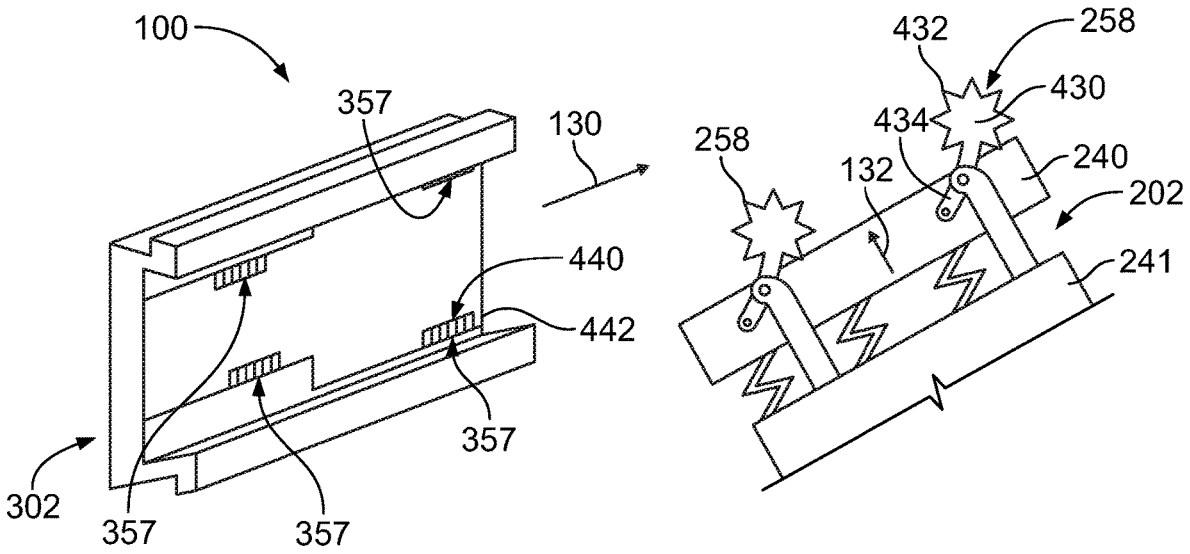
FIG. 23 is a perspective view of a portion of the connector system in accordance with an exemplary embodiment showing a portion of the first electrical connector and a portion of the second electrical connector.

FIG. 23 is a perspective view of a portion of the communication system 100 in accordance with an exemplary embodiment showing a portion of the first electrical connector 202 and a portion of the second electrical connector 302. The first and second electrical connectors 202, 302 are similar to the embodiments described above; however, the first electrical connector 202 and the second electrical connector 302 include gears to actuate the mating housing 240 rather than cam levers. The drive member 258 in the illustrated embodiment includes a crank gear 430 having gear teeth 432. The crank gear 430 includes a lever 434 operably coupled to the mating housing 240 and the receptacle housing 241. The actuator 357 in the illustrated embodiment includes a rack 440 having gear teeth 442. The crank gear 430 engages the rack 440 and is actuated to move the mating housing 240 relative to the receptacle housing 241 in the connector mating direction 132. For example, the lever 434 may be rotated to move the mating housing 240. Other types of gears may be provided in alternative embodiments, such as in idler gear, a worm gear or another type of gear.

Figure 24:
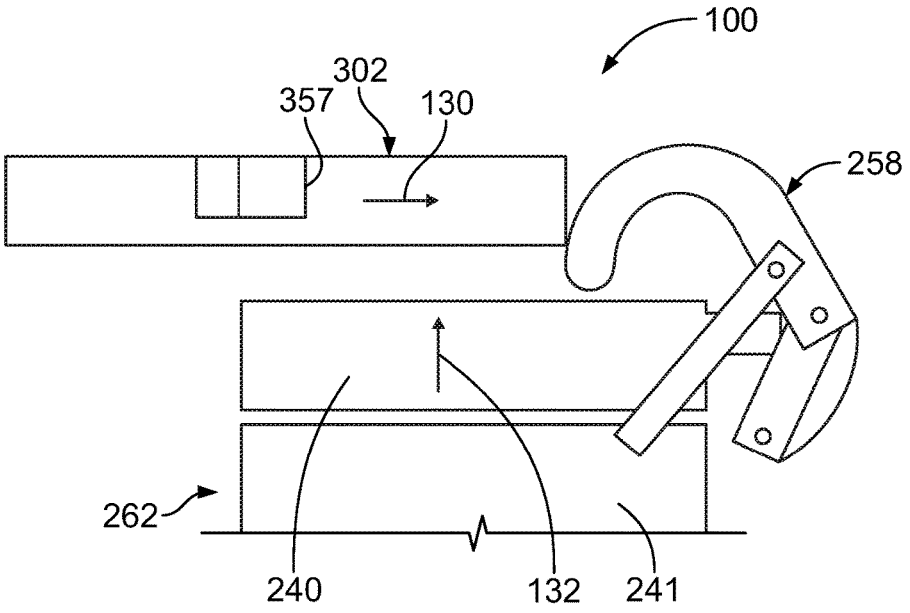
FIG. 24 is a perspective view of a portion of the connector system in accordance with an exemplary embodiment showing a portion of the first electrical connector and a portion of the second electrical connector.

FIG. 24 is a perspective view of a portion of the communication system 100 in accordance with an exemplary embodiment showing a portion of the first electrical connector 202 and a portion of the second electrical connector 302. The first and second electrical connectors 202, 302 are similar to the embodiments described above; however, the first electrical connector 202 and the second electrical connector 302 include linkages to actuate the mating housing 240 rather than cam levers or gears. The drive member 258 in the illustrated embodiment includes a four bar linkage. The linkage is rotated to cause linear actuation of the mating housing 240 in the connector mating direction 132.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A communication system comprising:

a first circuit card assembly having a first printed circuit board (PCB) and a first electrical connector mounted to the first PCB, the first electrical connector having a first mating end and first contacts at the first mating end, each of the first contacts having a first mating interface, the first electrical connector having a receptacle housing and a mating housing received in the receptacle housing and being movable in the receptacle housing in a connector mating direction along a connector mating axis; and a second circuit card assembly having a second PCB and a second electrical connector mounted to the second PCB, the second electrical connector having a second mating end and second contacts at the second mating end, each of the second contacts having a second mating interface, the second electrical connector having a header housing holding the second contacts, the second mating end being oriented parallel to the second PCB, the second mating interfaces of the second contacts being arranged along the second mating end;

wherein at least one of the first PCB and the second PCB includes a slot receiving the other of the first PCB and the second PCB in a board loading direction along a board loading axis;

wherein the receptacle housing is coupled to the header housing in the board loading direction as the first PCB and the second PCB are mated, and wherein the mating housing is movable within the receptacle housing toward the header housing in the connector mating direction generally perpendicular to the board loading direction;

wherein the first electrical connector includes a driving element operably coupled to the mating housing, the driving element engaging the second electrical connector to force the mating housing to move in the connector mating direction.

2. The communication system of claim 1, wherein the mating housing moves in the board loading direction with the receptacle housing and is configured to move independent of the receptacle housing in the connector mating direction.

3. The communication system of claim 1, wherein the driving element of the first electrical connector includes a cam lever operably coupled between the receptacle housing and the mating housing, the cam lever engaging the second electrical connector to move the cam lever and force the mating housing to move relative to the receptacle housing.

4. The communication system of claim 1, wherein the first electrical connector includes a cam lever pivotably coupled to the receptacle housing and pivotably coupled to the mating housing, the cam lever having a cam surface configured to engaging the second electrical connector to move the cam lever and force the mating housing to move relative to the receptacle housing toward the header housing, the cam lever having a return cam surface configured to engaging the second electrical connector to move the cam lever and force the mating housing to move relative to the receptacle housing away the header housing.

5. The communication system of claim 1, wherein the first electrical connector includes a cam lever having a body including a first side and a second side, the cam lever includes a fixed pivot extending from the first side being pivotably coupled to the receptacle housing, the cam lever includes a movable pivot coupled to the mating housing, the cam lever includes a cam surface engaging the second electrical connector to cause rotation of the body about the fixed pivot, the rotation of the body causes the movable pivot to move relative to the receptacle housing causing the mating housing to move relative to the receptacle housing.

6. The communication system of claim 1, wherein the header housing includes a wall defining a cavity configured to receive the mating housing, the wall having an actuator engaging the first electrical connector to actuate and move the mating housing relative to the receptacle housing.

7. The communication system of claim 1, wherein the header housing includes a wall defining a cavity configured to receive the mating housing, the wall having an actuator including a ramp surface, the first electrical connector includes a cam lever pivotably coupled to the receptacle housing and pivotably coupled to the mating housing, the cam lever engaging the ramp surface to move the cam lever and force the mating housing to move relative to the receptacle housing.

8. The communication system of claim 1, wherein the first electrical connector includes a front section and a rear section, the first electrical connector having a first driving element operably coupled to the mating housing at the front section for driving the mating housing in the connector mating direction relative to the receptacle housing at the front section and a second driving element operably coupled to the mating housing at the rear section for driving the mating housing in the connector mating direction relative to the receptacle housing at the rear section.

9. The communication system of claim 1, wherein the first electrical connector includes a top and a bottom, the first electrical connector having a first driving element operably coupled to the mating housing at the top for driving the mating housing in the connector mating direction relative to the receptacle housing at the top and a second driving element operably coupled to the mating housing at the bottom for driving the mating housing in the connector mating direction relative to the receptacle housing at the bottom.

10. The communication system of claim 1, wherein the header housing includes a gear member having gear teeth, the first electrical connector includes a crank having crank gear teeth engaging the gear teeth of the gear member causing the crank to rotate, the crank being operably coupled to the mating housing and causing the mating housing to move in the connector mating direction as the crank rotates.

11. The communication system of claim 1, wherein the header housing includes an actuator, the first electrical connector includes a lever and at least one link member coupled to the lever and operably coupled to the mating housing, the lever engaging the actuator causing the at least one link member to move causing the mating housing to move in the connector mating direction.

12. The communication system of claim 1, wherein the first and second PCBs move relative to each other along the board loading axis, the receptacle housing moves relative to the header housing along the board loading axis, and the mating housing moves relative to the header housing along the connector mating axis perpendicular to the board mating axis.

13. The communication system of claim 1, wherein either the first PCB or the second PCB is oriented horizontally and the other of the first PCB or the second PCB is oriented vertically.

14. The communication system of claim 1, wherein the first mating end is oriented perpendicular to the first PCB, and wherein the second mating end is oriented parallel to the second PCB.

15. A communication system comprising:

a first circuit card assembly having a first printed circuit board (PCB) and a first electrical connector mounted to the first PCB, the first electrical connector having a first mating end and first contacts at the first mating end, each of the first contacts having a first mating interface, the first electrical connector having a receptacle housing and a mating housing received in the receptacle housing and being movable in the receptacle housing in a connector mating direction along a connector mating axis; and a second circuit card assembly having a second PCB and a second electrical connector mounted to the second PCB, the second electrical connector having a second mating end and second contacts at the second mating end, each of the second contacts having a second mating interface, the second electrical connector having a header housing holding the second contacts;

wherein at least one of the first PCB and the second PCB includes a slot receiving the other of the first PCB and the second PCB in a board loading direction along a board loading axis;

wherein the receptacle housing is coupled to the header housing in the board loading direction as the first PCB and the second PCB are mated, and wherein the mating housing is movable within the receptacle housing toward the header housing in the connector mating direction generally perpendicular to the board loading direction; and wherein the first electrical connector includes a cam lever pivotably coupled to the receptacle housing and pivotably coupled to the mating housing, the cam lever engaging the second electrical connector to move the cam lever and force the mating housing to move relative to the receptacle housing.

16. The communication system of claim 15, wherein the mating housing moves in the board loading direction with the receptacle housing and is configured to move independent of the receptacle housing in the connector mating direction.

17. The communication system of claim 15, wherein the first mating end is oriented perpendicular to the first PCB, and wherein the second mating end is oriented parallel to the second PCB.

18. A circuit card assembly for a communication system comprising:

a printed circuit board (PCB) having a first surface and a second surface and a mating edge between the first and second surfaces, the PCB having a slot extending inward from the mating edge configured to receive a second PCB of a second circuit card assembly in a board loading direction perpendicular to the mating edge, the PCB having a mounting area on the first surface adjacent the slot; and an electrical connector mounted to the first surface at the mounting area configured for mating with a second electrical connector of the second circuit card assembly, the electrical connector having a receptacle housing mounted to the PCB and a mating housing received in a cavity of the receptacle housing and being movable relative to the receptacle housing, the electrical connector extending between a front and a rear, the front being provided proximate to the mating edge, the receptacle housing having a mounting end extending between the front and the rear being mounted to the PCB at the mounting area, the mating housing having a mating end extending between the front and the rear, the mating end being configured to be mated to the second electrical connector, the mating housing having an inner end opposite the mating end, the inner end facing the cavity, the electrical connector having contacts held by the mating housing and being movable relative to the receptacle housing with the mating housing;

wherein the receptacle housing is configured to be coupled to the second electrical connector as the second PCB is loaded in the board loading direction, and wherein the mating housing is movable within the receptacle housing toward the second electrical connector in a connector mating direction generally perpendicular to the board loading direction; and wherein the electrical connector includes a driving element operably coupled to the mating housing, the driving element configured to engage the second electrical connector to force the mating housing to move in the connector mating direction.

19. The circuit card assembly of claim 18, wherein the mating housing moves in the board loading direction with the receptacle housing and is configured to move independent of the receptacle housing in the connector mating direction.

20. The circuit card assembly of claim 18, wherein the driving element of the electrical connector includes a cam lever pivotably coupled to the receptacle housing and pivotably coupled to the mating housing, the cam lever configured to engage the second electrical connector to move the cam lever and force the mating housing to move relative to the receptacle housing.

* * * * *